US010145080B2

(12) United States Patent
Segroves et al.

(10) Patent No.: US 10,145,080 B2
(45) Date of Patent: Dec. 4, 2018

(54) STRUCTURALLY ENHANCED GEOTEXTILE SEDIMENT-CONTROL FENCES

(71) Applicant: Denny Hastings FLP 14, Shelbyville, TN (US)

(72) Inventors: Thomas Kyle Segroves, Shelbyville, TN (US); Stephen Matthew Sliger, Bell Buckle, TN (US); Kevin Brian Wolfe, Franklin, TN (US)

(73) Assignee: Denny Hastings FLP 14, Shelbyville, TN (US)

( * ) Notice: Subject to any disclaimer, the term of this patent is extended or adjusted under 35 U.S.C. 154(b) by 0 days.

(21) Appl. No.: 15/179,666

(22) Filed: Jun. 10, 2016

(65) Prior Publication Data

US 2016/0362865 A1 Dec. 15, 2016

Related U.S. Application Data

(60) Provisional application No. 62/173,736, filed on Jun. 10, 2015, provisional application No. 62/294,841, filed on Feb. 12, 2016, provisional application No. 62/295,876, filed on Feb. 16, 2016.

(51) Int. Cl.
*E02D 17/20* (2006.01)
*E01F 7/02* (2006.01)

(52) U.S. Cl.
CPC ..... *E02D 17/202* (2013.01); *E01F 7/02* (2013.01); *E02D 2220/00* (2013.01); *E02D 2300/0087* (2013.01); *E02D 2600/30* (2013.01)

(58) Field of Classification Search
USPC ..... 405/302.4, 302.6, 302.7, 15, 21; 256/12.5
See application file for complete search history.

(56) References Cited

U.S. PATENT DOCUMENTS

| | | | | |
|---|---|---|---|---|
| 1,964,419 | A | 6/1934 | Asten | |
| 4,279,535 | A * | 7/1981 | Gagliardi | E02D 17/202 405/15 |
| 4,756,511 | A | 7/1988 | Wright, III | |
| 5,108,224 | A | 4/1992 | Cabaniss et al. | |
| 5,201,497 | A | 4/1993 | Williams et al. | |
| 5,616,399 | A * | 4/1997 | Theisen | E02D 17/202 139/408 |
| 5,735,640 | A | 4/1998 | Meyer et al. | |
| 5,758,868 | A | 6/1998 | Shea | |
| 5,877,096 | A | 3/1999 | Stevenson et al. | |
| 5,954,451 | A | 9/1999 | Presby | |

(Continued)

OTHER PUBLICATIONS

Natural Resources Conservation Service, Wisconsin DNR, "Sediment Basin (No.) Code 350", pp. 1-7, Sep. 1990.

(Continued)

*Primary Examiner* — Sean D Andrish
(74) *Attorney, Agent, or Firm* — Christopher J. Owens; Leech Tishman Fuscaldo & Lampl

(57) ABSTRACT

Sediment-control fences that are structurally enhanced to prevent failure due to hydrostatic and hydrodynamic forces are disclosed. The sediment-control fences comprise a permeable geotextile material and reinforcing straps located at controlled heights. The reinforcing straps provide added strength and stiffness at key structural locations along the height of the sediment-control fence.

34 Claims, 9 Drawing Sheets

(56) References Cited

U.S. PATENT DOCUMENTS

| | | | | |
|---|---|---|---|---|
| 7,465,129 | B2 | 12/2008 | Singleton | |
| RE42,695 | E | 9/2011 | Singleton | |
| 8,465,231 | B2 | 6/2013 | Hunt | |
| 2002/0172564 | A1 | 11/2002 | Brown | |
| 2004/0076482 | A1 | 4/2004 | Singleton | |
| 2006/0133900 | A1 | 6/2006 | Singleton | |
| 2007/0069191 | A1 | 3/2007 | Arnold et al. | |
| 2008/0112766 | A1 | 5/2008 | Kerman | |
| 2011/0305530 | A1 | 12/2011 | Hunt | |
| 2012/0077005 | A1* | 3/2012 | Chen | B29C 51/004 428/216 |
| 2014/0072375 | A1* | 3/2014 | Ortega | D04H 13/00 405/302.7 |
| 2014/0154018 | A1* | 6/2014 | Singleton | E02B 3/00 405/302.7 |

OTHER PUBLICATIONS

Ingold, "The Geotextiles and Geomembranes Manual", First Edition, Introduction, pp. 1-70, 1994.
Henry et al., "Silt Fence Testing for Eagle River Flats Dredging", Special Report 95-27, pp. 1-9 and 11-14, Dec. 1995.
Barrett et al., "An evaluation of geotextiles for temporary sediment control", pp. 283-290, May/Jun. 1998.
Koerner, "Designing with Geosynthetics", Fourth Edition, pp. 27-33, Jul. 1999.

* cited by examiner

STRUCTURALLY ENHANCED GEOTEXTILE SEDIMENT-CONTROL FENCES

CROSS-REFERENCE TO RELATED APPLICATION

This application claims the benefit of U.S. Provisional Patent Application Ser. No. 62/173,736 filed Jun. 10, 2015, U.S. Provisional Patent Application Ser. No. 62/294,841 filed Feb. 12, 2016 and U.S. Provisional Patent Application Ser. No. 62/295,876 filed Feb. 16, 2016, all which are incorporated herein by reference.

FIELD OF THE INVENTION

The invention relates to sediment-control fences that are structurally enhanced to provide improved performance.

BACKGROUND INFORMATION

Silt fences have been installed in topographically low areas where concentrated flow will collect, often resulting in the overtopping and failure of such fencing. Conventional silt fences have not been structurally capable of resisting the forces associated with high water depths accumulating behind the fence and hydrodynamic forces associated with overtopping. Recent developments in silt fencing include hybrid fabrics with graduated sections of geotextile material having increasing water flux rates directly correlating with increasing fence height. However, these hybrid-fabric fences are not effective in preventing overtopping due to the overwhelming magnitude of runoff flow rates associated with storm events. Wire or chain-link backing has been used on silt fences in order to provide added tensile strength and high-modulus support so that the fabric portion of the fence does not excessively deflect/elongate/sag and ultimately fail due to high tensile stresses, fabric tearing and overtopping.

SUMMARY OF THE INVENTION

The present invention provides sediment-control fences that are structurally enhanced to prevent failure due to hydrostatic and hydrodynamic forces. The sediment-control fences comprise a permeable geotextile material and reinforcing straps located at controlled heights. The reinforcing straps provide added strength and stiffness at key structural locations along the height of the sediment-control fence.

An aspect of the present invention is to provide a sediment-control fence comprising: a permeable geotextile material having a lower grade line and an upper edge defining an installed height extending between the lower grade line and the upper edge, an overtopping strap adjacent to the upper edge of the permeable geotextile material, and a primary center of pressure strap running along a length of the permeable geotextile material at a height between the lower grade line and the upper edge corresponding to a height of the center of pressure at overtopping.

Another aspect of the present invention is to provide a sediment-control fence system comprising: anchoring posts, a permeable geotextile material having a lower grade line and an upper edge defining an installed height extending between the lower grade line and the upper edge, an overtopping strap adjacent to the upper edge of the permeable geotextile material, and a primary center of pressure strap running along a length of the permeable geotextile material at a height between the lower grade line and the upper edge corresponding to a height of the center of pressure at overtopping, wherein the sediment-control fence is attachable to the anchoring posts with a plurality of fasteners.

These and other aspects of the present invention will be more apparent from the following description.

DETAILED DESCRIPTION

The present invention provides sediment-control fences designed to withstand hydrostatic forces associated with elevated backwater against the fence that may be equal to the maximum above-ground height of the fence. The sediment-control fences of the present invention may be used without the necessity of wire or chain-link backed supports that are conventionally used to resist structural failure due to hydraulic overtopping of the fence.

Figure 1:
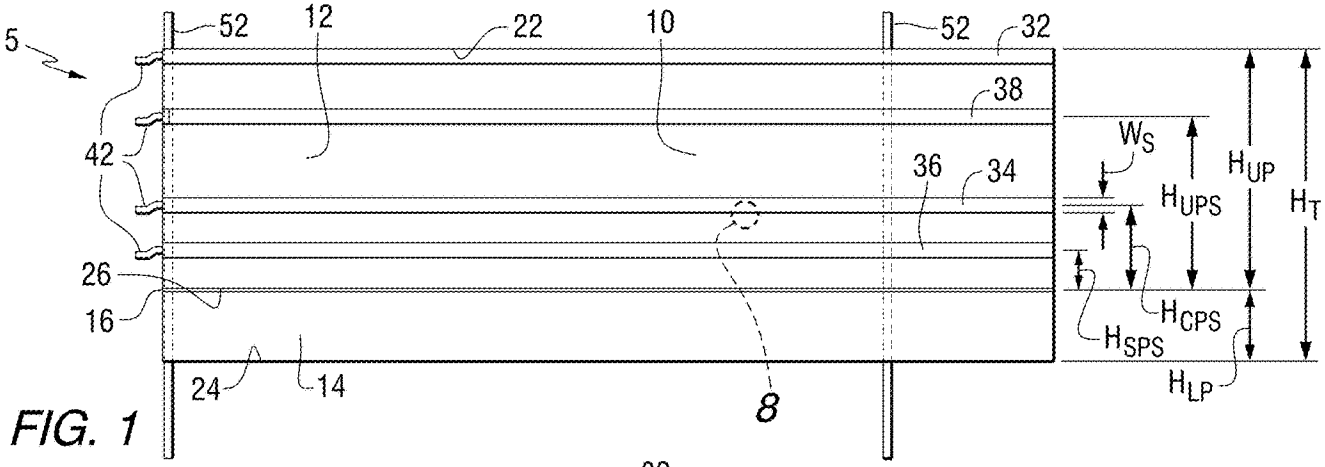
FIG. 1 is a front view of a sediment-control fence in accordance with an embodiment of the present invention.
Figure 2:
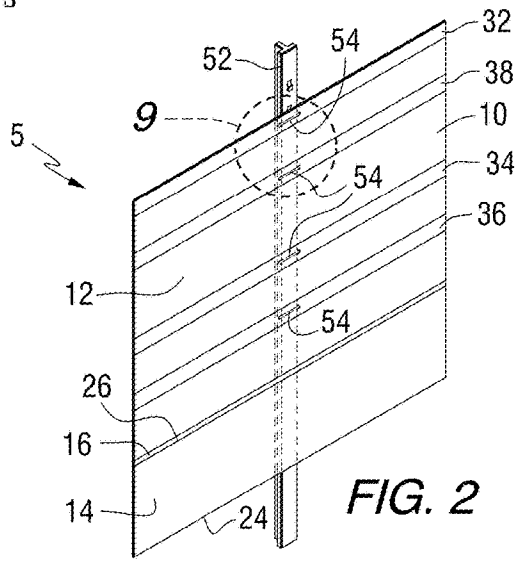
FIG. 2 is an isometric view of the sediment-control fence of FIG. 1.

FIGS. 1 and 2 illustrate a sediment-control fence 5 comprising a permeable geotextile material 10 in accordance with an embodiment of the invention. The permeable geotextile material 10 is water permeable. An upper portion 12 of the sediment-control fence 5 forms a vertical wall above the ground surface when the sediment-control fence 5 is installed at a site, while a lower anchoring portion 14 of the sediment-control fence 5 is located below grade when the sediment-control fence is installed. An anchoring guide line 16 may be marked at the intersection of the upper and lower portions 12, 14 in order to help install the sediment-control fence 5 at the appropriate level.

In accordance with certain embodiments, the upper portion 12 has an upper edge 22 and the lower portion 14 has a bottom edge 24. When the lower portion 14 is secured below grade, a lower grade line 26 of the sediment-control fence 5 is formed. The lower grade line 26 is formed at the portion of the sediment-control fence 5 intersecting the ground surface. As shown in FIGS. 1 and 2, lower grade line 26 may be formed at the anchoring line 16.

As shown in FIG. 1, the permeable geotextile material 10 of the sediment-control fence 5 has a total height $H_T$, the upper portion 12 has a height $H_{UP}$ and the lower portion 14 has a height $H_{LP}$. The upper portion 12 height $H_{UP}$ may also be considered the installed height as measured between the lower grade line 26 and the upper edge 22. The lower portion 14 height $H_{LP}$ may be defined from the lower grade line 26 to the bottom edge 24. The dimensions of the sediment-control fence 5 may be varied depending on the intended use thereof. For example, the total height $H_T$ of the sediment-control fence 5 may range from 1.5 to 6 feet, or from 2 to 5.5 feet, or from 2.5 to 5 feet. The upper portion 12 height $H_{UP}$ may range from 1 to 5 feet, or from 1.5 to 4.5 feet, or from 2 to 4 feet. The lower portion 14 height $H_{LP}$ may range from zero to 2 feet, or from 2 to 18 inches, or from 4 to 14 inches.

As shown in FIGS. 1 and 2, the upper portion 12 of the sediment-control fence 5 may include reinforcing straps 32, 34, 36 and 38 along the fence profile which run along the length of the sediment-control fence 5, e.g., along the longitudinal or machine direction of the permeable geotextile material 10. While four reinforcing straps 32, 34, 36 and 38 are shown in the embodiment of FIGS. 1 and 2, the sediment-control fence 5 of the present invention may be equipped with any other desired number of reinforcing straps, such as one, two, three, five, six or more reinforcing straps. In certain embodiments, the reinforcing straps may include overtopping strap 32, primary center of pressure strap 34, secondary center of pressure strap 36 and upper pressure strap 38.

In accordance with embodiments of the invention, the overtopping strap 32 may be located adjacent to the upper edge 22 of upper portion 12. The pressure straps 34, 36 and 38 are located at controlled heights from the lower grade line 26, as measured from the center of each pressure strap to the lower grade line 26. Each of the overtopping strap 32 and pressure straps 34, 36 and 38 have widths that are selected to provide desired mechanical properties for the sediment-control fence 5 while providing the desired water flow characteristics. For example, the primary center of pressure strap 34 has a width labeled $W_S$, as shown in FIG. 1.

The primary center of pressure strap 34 is located at a height $H_{CPS}$ from the lower grade line 26, as shown in FIG. 1. As more fully described below, the height $H_{CPS}$ of the primary center of pressure strap 34 corresponds to a center of pressure at overtopping. As used herein, the term "center of pressure at overtopping" means the height $H_{CP}$ of the center of pressure when the water level behind the sediment-control fence 5 is at the upper edge 22 of the sediment-control fence 5. In accordance with an embodiment of the present invention, the height $H_{CP}$ of the center of pressure at overtopping falls within the width $W_S$ of the primary center of pressure strap 34. For example, the height $H_{CP}$ of the center of pressure at overtopping may be equal to the height $H_{CPS}$ of the primary center of pressure strap 34 measured at the midpoint of the width $W_S$ of the primary center of pressure strap 34.

The secondary center of pressure strap 36 is located at a height $H_{SPS}$ from the lower grade line 26, as shown in FIG. 1. As more fully described below, the height $H_{SPS}$ of the secondary center of pressure strap 36 corresponds to a center of pressure at half overtopping. As used herein, the term "center of pressure at half overtopping" means the height $H_{CP}$ of the center of pressure when the water level behind the sediment-control fence 5 is halfway to the upper edge 22 of the sediment-control fence 5 from the ground surface. In accordance with an embodiment of the present invention, the height $H_{CP}$ of the center of pressure at half overtopping falls within the width $W_S$ of the secondary center of pressure strap 36. For example, the height $H_{CP}$ of the center of pressure at half overtopping may be equal to the height $H_{SPS}$ of the secondary center of pressure strap 36 measured at the midpoint of the width $W_S$ of the secondary center of pressure strap 36.

The upper pressure strap 38 is located at a height $H_{UPS}$ from the lower grade line 26, as shown in FIG. 1. As more fully described below, the height $H_{UPS}$ is selected in order to optimize the stiffness or modulus of the sediment-control fence 5 in its upper region. In certain embodiments, the height $H_{UPS}$ of the upper pressure strap 38 is located at or above the midpoint between the overtopping strap 32 and the primary center of pressure strap 34. In a particular embodiment, the entire width $W_S$ of the upper pressure strap 36 is located at or above the midpoint between the overtopping strap 32 and the primary center of pressure 34. As more fully described below, placing the upper pressure strap 38 at or above the midpoint allows desirable flow characteristics in the region between the primary center of pressure strap 34 and the upper pressure strap 38 while providing improved stiffness.

Figure 3:
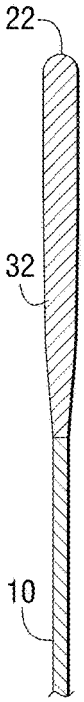
FIG. 3 is a partially schematic side sectional view of an overtopping strap in accordance with an embodiment of the present invention.
Figure 4:
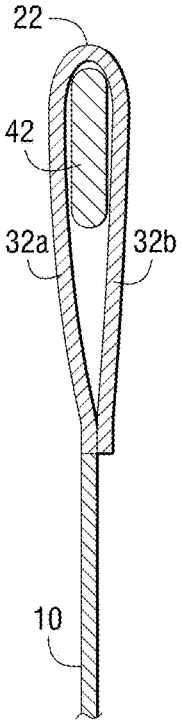
FIG. 4 is a partially schematic side sectional view of an overtopping strap in accordance with another embodiment of the present invention.
Figure 5:
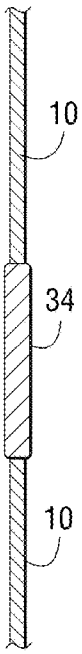
FIG. 5 is a partially schematic side sectional view of a pressure strap in accordance with an embodiment of the present invention.

As shown schematically in FIGS. 3 and 5, the overtopping strap 32 and the pressure straps 34, 36 and 38 may be formed by interweaving a horizontal textile reinforcing belt of relatively high-tensile strength along a length of the permeable geotextile material 10. As shown schematically in FIGS. 4, 6 and 7, the overtopping strap 32*a*, 32*b* and at least one of the pressure straps 34*a*, 34*b* and 34*c*, 34*d* may be formed as reinforcing strap pockets in certain embodiments. Alternatively, the overtopping strap 32 and the pressure straps 34, 36 and 38 may be manufactured or loomed separately and bonded to the fence using a variety of methods including stitching, sonic welding, mechanical fasteners, adhesives, heat bonding and the like to create the overtopping strap 32 and the pressure straps 34, 36 and 38. As used herein, the term "reinforcing strap" or "strap" may refer to the overtopping strap 32 and the pressure straps 34, 36 and 38 formed by any suitable method.

As shown schematically in FIG. 3, the overtopping strap 32 may be formed as a reinforcing strap by interweaving a textile reinforcing belt of high-tensile strength along a length of the permeable geotextile material 10. Alternatively, the overtopping strap 32 may be formed as reinforcing strap by manufacturing or looming a textile reinforcing belt of high-tensile strength separately and bonding it to the permeable geotextile material 10 adjacent to the upper edge 22 of the sediment-control fence 5 using a variety of methods including stitching, sonic welding, mechanical fasteners, adhesives, heat bonding and the like to create a reinforcing strap.

As shown schematically in FIG. 4, the overtopping strap 32*a*, 32*b* may be formed as a reinforcing strap pocket by a horizontal textile reinforcing belt of high-tensile strength into the permeable geotextile material 10, and then folding and bonding the textile reinforcing belt onto itself and/or onto the permeable geotextile material 10 using a variety of methods including stitching, sonic welding, mechanical fasteners, adhesives, heat bonding and the like to create a reinforcing strap pocket. Alternatively, the overtopping strap may be formed as reinforcing strap pocket by interweaving a textile reinforcing belt 32*a* of high-tensile strength into the permeable geotextile material 10 adjacent to the upper edge 22, and then stitching or otherwise bonding another strap 32*b* of textile reinforcing material over the interwoven belt to create a reinforcing strap pocket. In another embodiment, the overtopping strap may be may be formed as reinforcing strap pocket by weaving an integral channel into the permeable geotextile material 10. In a particular embodiment, the integral channel of an overtopping strap has first 32*a* and second 32*b* sides that may each comprise a single-ply structure and/or a two-ply structure.

As shown schematically in FIG. 5, the pressure straps 34, 36 and 38 may be formed as reinforcing straps by interweaving a textile reinforcing belt of high-tensile strength into the permeable geotextile material 10. Alternatively, the pressure straps 34, 36 and 38 may be formed as reinforcing straps by manufacturing or looming textile reinforcing belts of high-tensile strength separately and bonding them to the permeable geotextile material 10 using a variety of methods including stitching, sonic welding, mechanical fasteners, adhesives, heat bonding and the like to create the reinforcing straps.

Figure 6:
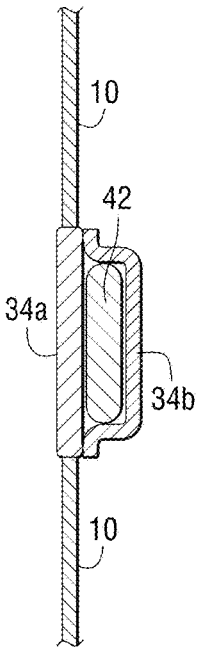
FIG. 6 is a partially schematic side sectional view of a pressure strap in accordance with another embodiment of the present invention.

As shown schematically in FIG. 6, the pressure straps may be formed as reinforcing strap pockets by interweaving a textile reinforcing belt 34*a* of high-tensile strength into the permeable geotextile material 10, and then stitching or otherwise bonding another strap 34*b* of textile reinforcing belt over the interwoven belt 34*a* to create a reinforcing strap pocket.

Figure 7:
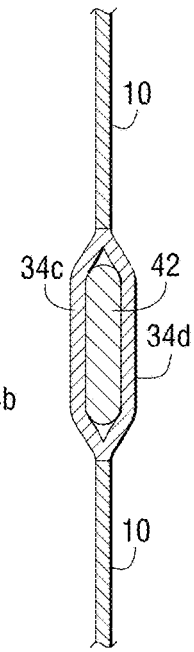
FIG. 7 is a partially schematic side sectional view of a pressure strap in accordance with a further embodiment of the present invention.

As shown schematically in FIG. 7, the pressure straps may be formed as reinforcing strap pockets by weaving an integral channel into the permeable geotextile material 10. In a particular embodiment, the integral channel of a pressure strap has first 34*c* and second 34*d* sides that may each comprise a single-ply structure and/or a two-ply structure. Alternatively, the pressure straps may be formed as reinforcing strap pockets by manufacturing or looming both the first reinforcing strap and second reinforcing strap of the reinforcing strap pocket separately and bonding them to the sediment-control fence 5 using a variety of methods including stitching, sonic welding, mechanical fasteners, adhesives, heat bonding and the like to create a reinforcing strap pocket. In an embodiment of the sediment-control fence 5, the pressure straps 34, 36 and 38 may each be formed as reinforcing strap pockets. However, the sediment-control fence 5 may include any desired number of reinforcing strap pockets, such as zero, one, two, three, four, five, six or more reinforcing strap pockets.

As shown in FIGS. 4, 6 and 7, when the overtopping strap 32*a*, 32*b* and the pressure straps 34*a*, 34*b* and 34*c*, 34*d* are formed as reinforcing strap pockets they may contain post-tensioning tendons 42. In certain embodiments, each reinforcing strap pocket may contain a single post-tensioning tendon 42. However, any other suitable number and arrangement of post-tensioning tendons 42 may be used. For example, from zero to six or more of the post-tensioning tendons 42 may be inserted as desired in any of the overtopping strap 32 and/or the pressure straps 34, 36 and 38. As shown in FIGS. 4 and 6, the post-tensioning tendon 42 may be free to move within the reinforcing strap pockets. Alternatively, the post-tensioning tendon 42 may be secured within the reinforcing strap pocket by any suitable means. The post-tensioning tendons 42 may be made of any suitable material, such as a woven polypropylene chord with a width and thickness selected to provide added strength and stiffness. For example, the width of each post-tensioning tendon 42 measured in the vertical direction in FIGS. 4 and 6 may range from 0.2 to 4 inches, or from 0.4 to 2 inches. However, any other suitable dimensions and materials may be used including rope, wire, string and the like.

As shown in FIG. 1, a length of the post-tensioning tendons 42 may extend from the sediment-control fence 5. The length of the post-tensioning tendons 42 extending from the sediment-control fence 5 may be wrapped around the anchoring post 52 during installation. Alternatively, the post-tensioning tendons may be completely contained within the sediment-control fence 5.

Each of the reinforcing straps 32, 34, 36 and 38 has a width $W_S$ selected to provide desired properties, such as strength and stiffness, at key structural locations along the height of the sediment-control fence 5 that will encounter elevated hydrostatic and hydrodynamic stresses and forces. For example, the widths $W_S$ of the reinforcing straps 32, 34, 36 and 38 may range from 0.5 inch to 4 inches, or from 1 inch to 3 inches, or from 1.5 to 2.5 inches. In certain embodiments, the reinforcing straps increase the strength of the sediment-control fence and provide increased modulus over the entire installed height of the sediment-control fence 5.

In accordance with certain embodiments, the surface area of upper portion 12 of sediment-control fence 5 comprises a greater amount of permeable geotextile material 10 than reinforcing straps 32, 34, 36 and 38. For example, greater than 50 percent of the surface area of upper portion 12 may be permeable geotextile material 10, or greater than 60 percent, or greater than 75 percent.

In accordance with certain embodiments, the sediment-control fence 5 fabric may have any suitable fabric weight. For example, the fabric weight may be from 100 to 400 gsm, or from 150 to 300 gsm, or from 180 to 250 gsm.

Figure 8:
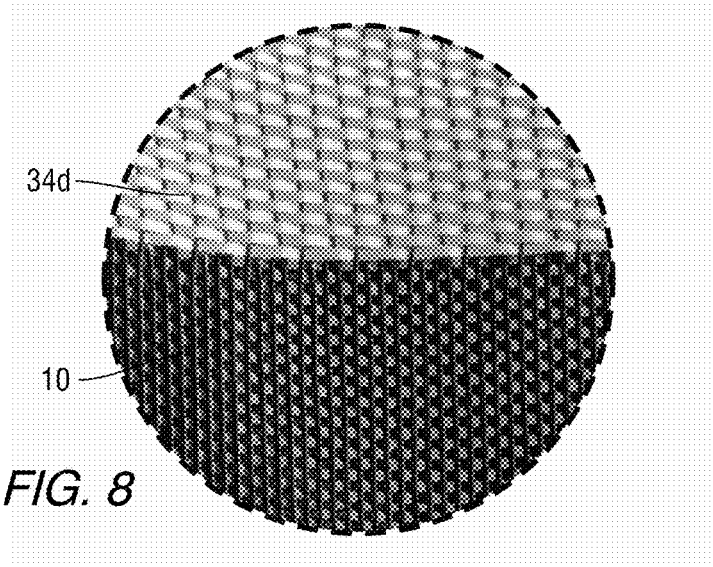
FIG. 8 is a magnified photograph of a portion of a sediment-control fence as shown in FIG. 1 in accordance with an embodiment of the present invention.

FIG. 8 is a magnified photograph of a portion of a sediment-control fence 5 as shown in FIG. 1, including a portion the permeable geotextile material 10 and a portion of the reinforcing strap 34*d*. In accordance with certain embodiments, the permeable geotextile material 10 and the primary center of pressure strap 34, as well as overtopping strap 32, secondary center of pressure strap 34 and upper pressure strap 38 may comprise woven filaments, as more fully described below.

In accordance with certain embodiments, the permeable geotextile material 10 may comprise woven filaments. For example, any suitable polymeric material can be used for the filaments of the woven permeable geotextile material 10 of the sediment-control fence 5, such as, polypropylene, polyester, polyethylene, polyethylene terephthalate, polyamide, nylon, rayon, fiberglass, polyvinylidene chloride, polytetrafluoroethylene (Teflon), aromatic polyamide aramid (Nomex), acrylic polymers, polyolefin and poly para-phenyleneterephthalamide (Kevlar) may be used. In certain embodiments, the filaments of the woven permeable geotextile material 10 may be polypropylene. Such polypropylene filaments may be formed during an extrusion process.

In certain embodiments, the filaments of the permeable geotextile material 10 may be continuous along the machine and/or transverse direction of the sediment-control fence 5. The denier of the filaments used in the permeable geotextile material 10 in the machine (warp) and transverse (fill, cross or weft) directions may be selected to provide desired properties. For example, the denier of the filaments may be from 500 to 5,000 denier, or from 700 to 3,000 denier, or from 800 to 1,300 denier. The filaments of the permeable geotextile material 10 may be provided in any suitable configuration, such as monofilament, multifilament, slit tape, fibrillated and the like. For example, the filaments of the woven permeable geotextile material 10 may be a monofilament polypropylene filament. The filaments may be any suitable cross-section shape such as semi-circular, ovular, rectangular, triangular, flat, round, hexagonal, x-shaped and the like. For example, the filaments of the permeable geotextile material 10 may comprise a substantially ovular cross-section. In the embodiment shown, the sediment-control fence 5, including the upper portion 12 and the lower portion 14, is made of a substantially consistent permeable geotextile material 10. The substantially consistent permeable geotextile material 10 results in a single flow, as more fully described below. In another embodiment, the permeable geotextile material 10 may be varied along the height of the sediment-control fence 5.

In accordance with certain embodiments, the selected filaments of the permeable geotextile material 10 may be loaded into a loom in the machine and transverse directions. The selected filaments may then be loomed or woven into the desired panel size using a selected weave such as plain, satin, twill, oxford, 3-dimensional or tubular, basket, leno, mock leno weaves and the like. For example, the permeable geotextile material 10 may be woven using a plain weave.

In accordance with certain embodiments, the overtopping strap 32 and the pressure straps 34, 36 and 38 may comprise woven filaments. For example, any suitable polymeric material can be used for the filaments of the overtopping strap 32 and the pressure straps 34, 36 and 38 of the sediment-control fence 5, such as, polypropylene, polyester, polyethylene, polyethylene terephthalate, polyamide, nylon, rayon, fiberglass, polyvinylidene chloride, polytetrafluoroethylene (Teflon), aromatic polyamide aramid (Nomex), acrylic polymers, polyolefin and poly para-phenyleneterephthalamide (Kevlar) may be used. In certain embodiments, the filaments of the overtopping strap 32 and the pressure straps 34, 36 and 38 may be polypropylene. Such polypropylene filaments may be formed during an extrusion process.

In certain embodiments, the filaments of the reinforcing straps 32, 34, 36 and 38 may be continuous along the machine and/or transverse direction of the sediment-control fence 5. The denier of the filaments used in the overtopping strap 32 and the pressure straps 34, 36 and 38 in the machine (warp) and transverse (fill, cross or weft) directions may be selected to provide desired properties. For example, the denier of the filaments may be from 500 to 5,000 denier, or from 700 to 3,000 denier, or from 800 to 1,300 denier. The filaments of the overtopping strap 32 and the pressure straps 34, 36 and 38 may be provided in any suitable configuration, such as monofilament, multifilament, slit tape, fibrillated and the like. For example, the filaments of the overtopping strap 32 and the pressure straps 34, 36 and 38 may be a monofilament polypropylene filament. The filaments may be any suitable cross-section shape such as semi-circular, ovular, rectangular, triangular, flat, round, hexagonal, x-shaped and the like. For example, the filaments of the reinforcing straps 32, 34, 36 and 38 may comprise a substantially ovular cross-section. In certain embodiments, when the reinforcing straps are formed as reinforcing strap pockets 32*a*, 32*b*, 34*a*, 34*b* and 34*c*, 34*d*, the filaments of the first layer of the reinforcing strap pocket may be the same material as the filaments of the second layer. However, the filaments of the first layer and second layer of the reinforcing straps pockets 32*a*, 32*b*, 34*a*, 34*b* and 34*c*, 34*d* may vary.

In accordance with certain embodiments, the selected filaments of the reinforcing straps 32, 34, 36 and 38 may be loaded into a loom in the machine and transverse directions. The selected filaments may then be loomed or woven into the desired panel size using a selected weave such as plain, satin, twill, oxford, 3-dimensional or tubular, basket, leno, mock leno weaves and the like. For example, the reinforcing straps 32, 34, 36 and 38 may be woven using a plain weave.

As shown in FIG. 8, the weave of the permeable geotextile material and the reinforcing straps 32, 34, 36 and 38 may vary. In the embodiment shown, the permeable geotextile material 10 may be woven using a single-ply plain weave. For example, in a single-ply weave there is a single warp filament layer in the machine direction throughout the thickness of the permeable geotextile material 10 that is woven with a single weft filament layer in the transverse direction. In the embodiment shown, the reinforcing straps 32, 34, 36 and 38 may be woven using a two-ply weave. As used herein, the term "two-ply" means that through the thickness of the reinforcing straps there are two layers of filaments in the warp and/or weft directions. In one embodiment, two layers of warp filaments of the two-ply material run in the machine direction. In another embodiment, two layers of filaments of the two-ply material run in the transverse direction.

In the embodiment shown in FIG. 8, the reinforcing straps 32, 34, 36 and 38 have two layers of warp filaments running in the machine direction, and a single layer of weft filaments running in the transverse direction to form the two-ply structure. The weft filaments are continuous along the height of the sediment-control fence 5, and are of the same configuration in the region of the permeable geotextile material 10 and the reinforcing straps 32, 34, 36 and 38. In this embodiment, one of the warp filaments in the machine direction passes under every fourth weft filament in the transverse direction within the two-ply structure. The other warp filament on the opposite side also passes under every fourth weft filament in the transverse direction, but offset from the opposing warp filament, e.g., the fourth weft filament in the transverse direction that the second warp filament in the machine direction passes under is in the middle of the three weft filaments in the transverse direction skipped by the first warp filament in the machine direction within the two-ply structure. This is known as a type of plain weave.

Figure 9:
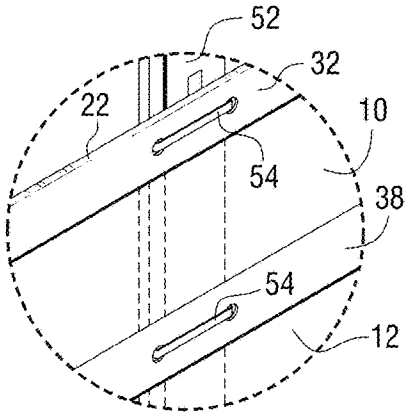
FIG. 9 is a partially schematic magnified portion of FIG. 2 showing the sediment-control fence secured to an anchoring post using a fastener in accordance with an embodiment of the present invention.

As shown in FIGS. 1, 2 and 9, the permeable geotextile material 10 of the sediment-control fence 5 may be secured to anchoring posts 52 with fasteners 54. The anchoring posts 52 may have a height configured to receive the sediment-control fence 5. The anchoring post 52 may be made of any suitable material such as metal, wood, plastic and the like. A portion of the anchoring post 52 may be installed below grade in the trench. In certain embodiments, the fasteners 54 are inserted through at least one of the reinforcing straps 32, 34, 36 and 38 of the sediment-control fence 5 using any suitable means and passed around the anchoring post 52. Alternatively or in addition, the fasteners 54 may be inserted through any portion of the permeable geotextile material 10 of the sediment-control fence using any suitable means and passed around the anchoring post 52.

Figure 11:
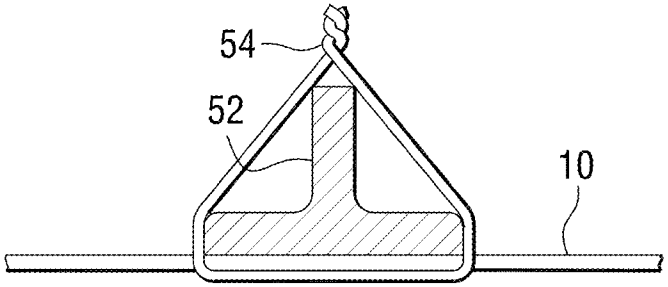
FIG. 11 is a top view of the sediment-control fence of FIG. 10 secured to an anchoring post using a fastener in accordance with an embodiment of the present invention.
Figure 10:
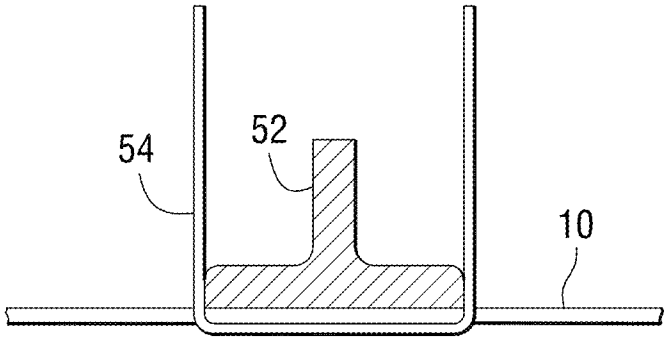
FIG. 10 is a top view of a sediment-control fence and a fastener for attachment to an anchoring post in accordance with an embodiment of the present invention.

As shown in FIGS. 10 and 11, the fastener 54 used to attach the sediment-control fence 5 to the anchoring post 52 may comprise a staple with two pointed legs. The pointed legs allow for the legs of the staple to be inserted through the permeable geotextile material 10 and the reinforcing straps 32, 34, 36 and 38 of the sediment-control fence 5. Alternatively, wire, zip-ties, clips, hooks, nails, screws, snaps, pins, rings, and the like may be used to attach the sediment-control fence to the anchoring posts 52. For example, stainless steel wire or nylon zip-ties.

As shown in FIGS. 12-16, the overtopping strap 32 and the pressure straps 34, 36 and 38 may be located at specific heights along installed height extending between the lower grade line 26 and the upper edge 22 of the sediment-control fence 5 that will encounter elevated hydrostatic and hydrodynamic pressures and forces. As used herein, the term "overtopping" corresponds to when the water level behind the sediment-control fence 5 is at the upper edge 22 of the sediment-control fence 5.

As shown in FIGS. 12-16, the sediment-control fence 5 experiences hydrostatic pressure along its upper portion 12 height $H_{UP}$ depending on the water level behind the sediment-control fence 5. The hydrostatic pressures experienced along the upper portion 12 height $H_{UP}$ of the sediment-control fence 5 can be represented by one single hydrostatic pressure resultant force vector that represents the overall center of pressure $F_R$. The hydrostatic pressure resultant force $F_R$ represents the center of the overall hydrostatic pressures acting on the sediment-control fence 5. The resultant center of pressure is calculated based on the linearly increasing hydrostatic pressures on the sediment-control fence 5 as the depth of water increases behind the fence. The maximum hydrostatic pressures are developed behind the fence at the lower third of the installed height. The center of pressure location is represented by the resultant force acting at the vertical fence location that is one-third of the water depth height as measured up from the ground surface. The height of the center of pressure $H_{CP}$ along the upper portion height $H_{UP}$ of the sediment-control fence 5 varies based on the water level behind the sediment-control fence 5. The location of pressure straps 34, 36 and 38 along the upper portion 12 height $H_{UP}$ provides added strength and stiffness locations along the fence height that will experience the moving center of pressure that changes location as the water level behind the fence changes. Overtopping results in the sediment-control fence 5 experiencing hydrodynamic forces at the upper edge 22 of upper portion 12. The hydrodynamic resultant force vector $FD_R$ represents the sum of the hydrodynamic forces experienced at the upper edge 22 of the upper portion 12 of the sediment-control fence 5.

In accordance with certain embodiments, the overtopping strap 32 and the pressure straps 34, 36 and 38, and the optional post-tensioning tendons 42, are located to withstand the hydraulic forces associated with backwater behind the sediment-control fence 5 and to provide enough stiffness, i.e., modulus, to keep the sediment-control fence 5 from sagging during rising water behind the sediment-control fence 5 and overtopping. Accordingly, the steel-wire and chain-link fence backings used for conventional silt fences are not required for the sediment-control fence 5.

The overtopping strap 32 may be located adjacent to the upper edge 22 of the upper portion 12 of the sediment-control fence 5. Overtopping results in the sediment-control fence 5 experiencing hydrodynamic forces at the upper edge 22 of upper portion 12. The location of the overtopping strap 32 provides excess stiffening at the top of the sediment-control fence 5 to resist material deflection and damage due to the hydrodynamic pressure and force experienced during overtopping.

In certain embodiments, the pressure straps 34, 36 and 38 are located at heights from the lower grade line 26 formed by the intersection of the sediment-control fence 5 and the ground surface. Depending on the water level behind the sediment-control fence 5, the center of pressure on the sediment-control fence 5 can range along the upper portion 12 height $H_{UP}$ of the sediment-control fence 5. The sediment-control fence 5 experiences the hydrostatic pressure resultant force $F_R$ at the center of pressure, as previously discussed. The location of the pressure straps 34, 36 and 38 along the upper portion 12 height $H_{UP}$ provides added strength and stiffness at the key structural locations along the fence height that will encounter the highest magnitude of hydrostatic pressure and the associated resultant force.

Figure 15:
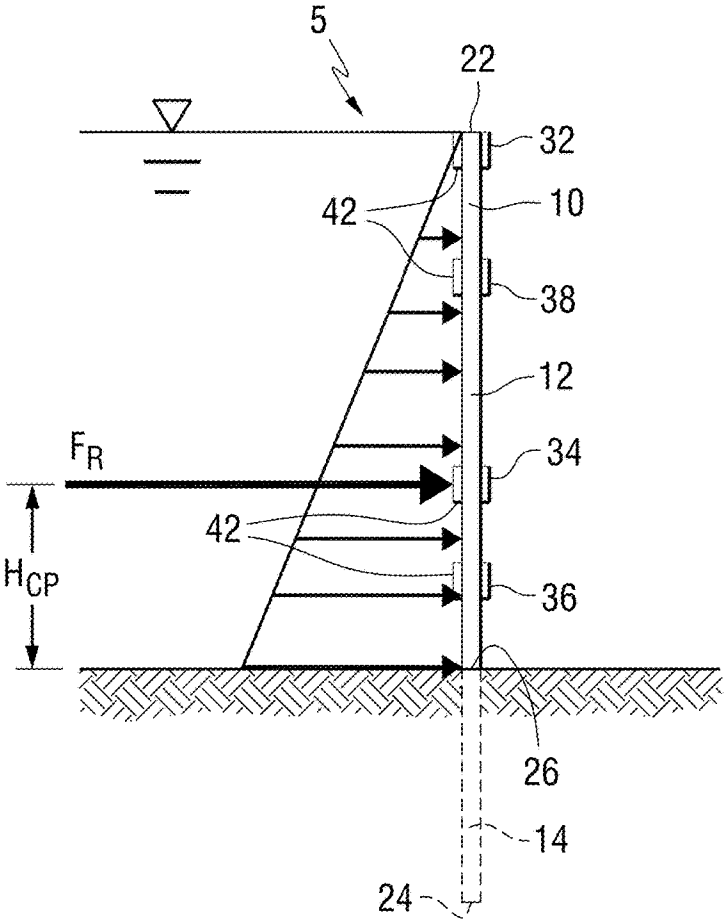

The primary center of pressure strap 34 is located at a height $H_{CPS}$ from the lower grade line 26. As shown in FIG. 15, at overtopping of the sediment-control fence 5 the center of pressure is located at height $H_{CP}$ from the lower grade line 26. The primary center of pressure strap 34 is located at a height $H_{CPS}$, such that at least a portion of the primary center of pressure strap 34 width $W_S$ is located at the center of pressure height $H_{CP}$ at overtopping. For example, the upper portion 12 height $H_{UP}$ may be 32 inches. The primary center of pressure strap 34 may have a strap width $W_S$ of 2 inches. At overtopping, the center of pressure height $H_{CP}$ may be 10.7 inches from the lower grade line 26. The primary center of pressure strap 34 may be located at a height $H_{CPS}$ 11 inches from the lower grade line 26. In certain embodiments, the primary center of pressure strap 34 may be located at a height $H_{CPS}$ from 30 to 38 percent of the upper portion 12 height $H_{UP}$, e.g., from 31 to 36 percent, or from 32 to 35 percent. In a particular embodiment, the primary center of pressure strap 34 may be located at a height $H_{CPS}$ 33.3 percent of the upper portion 12 height $H_{UP}$.

Figure 13:
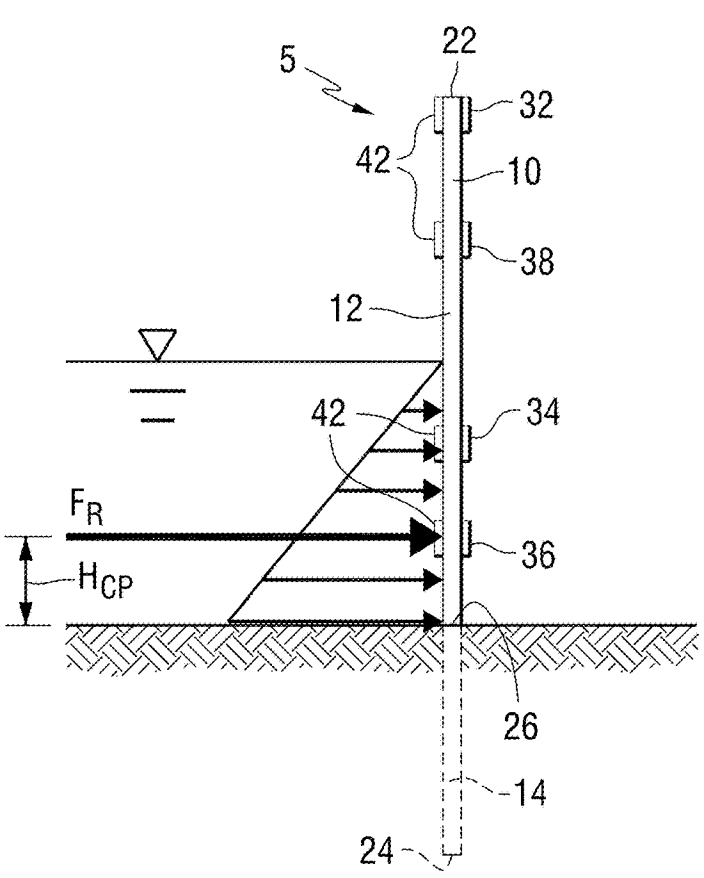
FIGS. 12-16 are partially schematic side views of a sediment-control fence as shown in FIG. 1 including free body diagrams for the hydrostatic and hydrodynamic forces at increasing water levels.

The secondary center of pressure strap 36 is located at a height $H_{SPS}$ from the lower grade line 26. As shown in FIG. 13, at half overtopping of the sediment-control fence 5 the center of pressure is located at height $H_{CP}$ from the lower grade line 26. The secondary center of pressure strap 36 is located at a height $H_{SPS}$, such that at least a portion of the secondary center of pressure strap 36 width $W_S$ is located at the center of pressure height $H_{CP}$ at half overtopping. For example, the upper portion 12 height $H_{UP}$ may be 32 inches. The secondary center of pressure strap 36 may have a strap width $W_S$ of 2 inches. At halfway to overtopping, the center of pressure height $H_{CP}$ may be 5.3 inches from the lower grade line 26. The secondary center of pressure strap 36 may be located at a height $H_{SPS}$ 5 inches from the lower grade line 26. The secondary center of pressure strap 36 is located at a height $H_{SPS}$ from 12 to 20 percent of the upper portion 12 height $H_{UP}$, e.g., from 14 to 19 percent, or from 15 to 18 percent. In a particular embodiment, the secondary center of pressure strap 36 may be located at a height $H_{SPS}$ 16.6 percent of the upper portion 12 height $H_{UP}$.

The primary center of pressure strap 34 and the secondary center of pressure strap 36 are positioned to handle the bulk of the hydrostatic pressures experienced along the upper portion 12 height $H_{UP}$ as water rises behind the sediment-control fence 5 from the ground surface up to the upper edge 22 of the sediment-control fence 5. The primary center of pressure strap 34 and the secondary center of pressure strap 36, along with lower portion 14 of the sediment-control fence 5 secured below grade, provide added tensile strength and modulus for the lower third of the upper portion 12 height $H_{UP}$ of the sediment-control fence 5.

The upper pressure strap 38 is located at a height $H_{UPS}$ from the lower grade line 26. At least a portion of the upper pressure strap 38 is located to optimize the stiffness or modulus of the sediment-control fence 5 in its upper region.

In certain embodiments, the height $H_{UPS}$ of the upper pressure strap 38 is at or above the midpoint between the overtopping strap 32 and the primary center of pressure strap 34. Providing additional reinforcing straps at a height from 35 to 65 percent of the upper portion 12 height $H_{UP}$, e.g., from 40 to 60 percent, may not add any appreciable, required structural benefit. In addition, reinforcing straps at these heights reduce the needed flux and permittivity through the sediment-control fence 5, since the reinforcing straps 32, 34, 36 and 38 may have a lower flux and permittivity than the permeable geotextile material 10. Locating the upper pressure strap at a height $H_{UPS}$ at or above the midpoint between the overtopping strap 32 and the primary center of pressure strap 34 allows for a larger surface area of the permeable geotextile material 10 between the primary pressure strap 34 and the upper pressure strap 38. This relatively large surface area allows for the backwater behind the sediment-control fence 5 to filter through permeable geotextile material 10 more readily. For example, the upper portion 12 height $H_{UP}$ may be 32 inches. The upper pressure strap 38 may have a strap width $W_S$ of 2 inches. The upper pressure strap 38 may be located at a height $H_{UPS}$ from 23 inches from the lower grade line 26. In certain embodiments, the upper pressure strap 38 is located at a height $H_{UPS}$ from 67 to 77 percent of the upper portion 12 height $H_{UP}$, e.g., from 69 to 75 percent, or from 70 to 74 percent. In a particular embodiment, the upper pressure strap 38 may be located at a height $H_{UPS}$ 71.8 percent of the upper portion 12 height $H_{UP}$.

Figure 12:
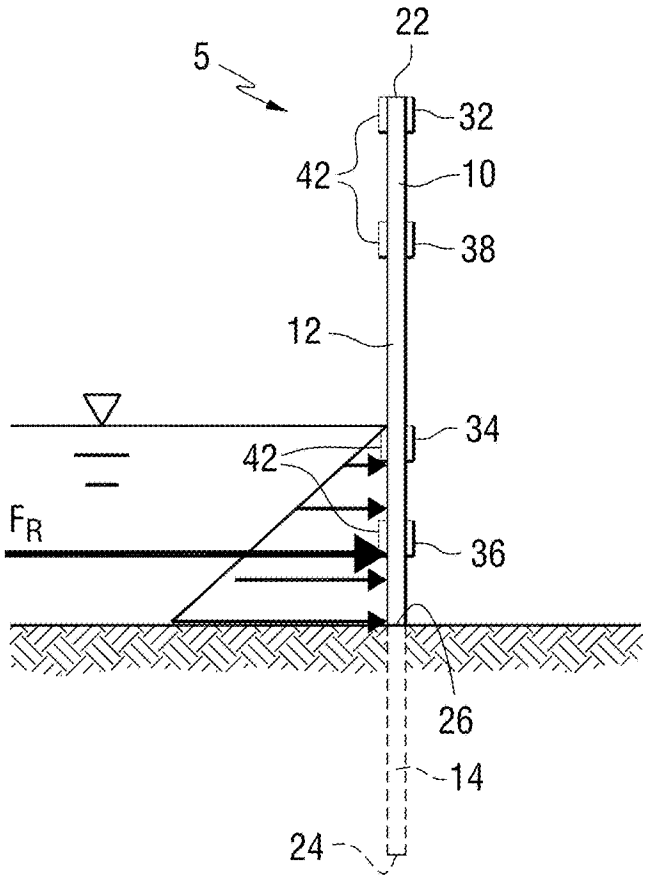

As shown in FIG. 12, at a 12-inch from the ground surface water level, the sediment-control fence 5 experiences certain hydrostatic forces. The sediment-control fence 5 may experience the hydrostatic pressure resultant force $F_R$ at a center of pressure height approximately 4 inches from the lower grade line 26. In certain embodiments, at least a portion of secondary center of pressure strap 36 may be located at the center of pressure height. The secondary center of pressure strap 36 will provide added strength and stiffness to reduce any potential deflection of the sediment-control fence 5.

As shown in FIG. 13, at a 16-inch from the ground surface water level, the sediment-control fence 5 experiences certain hydrostatic forces. The sediment-control fence 5 may experience the hydrostatic pressure resultant force $F_R$ at a center of pressure height approximately 5.3 inches from the lower grade line 26. In certain embodiments, at least a portion of secondary center of pressure strap 36 may be located at the center of pressure. The secondary center of pressure strap 36 will provide added strength and stiffness to reduce any potential deflection of the sediment-control fence 5.

Figure 14:
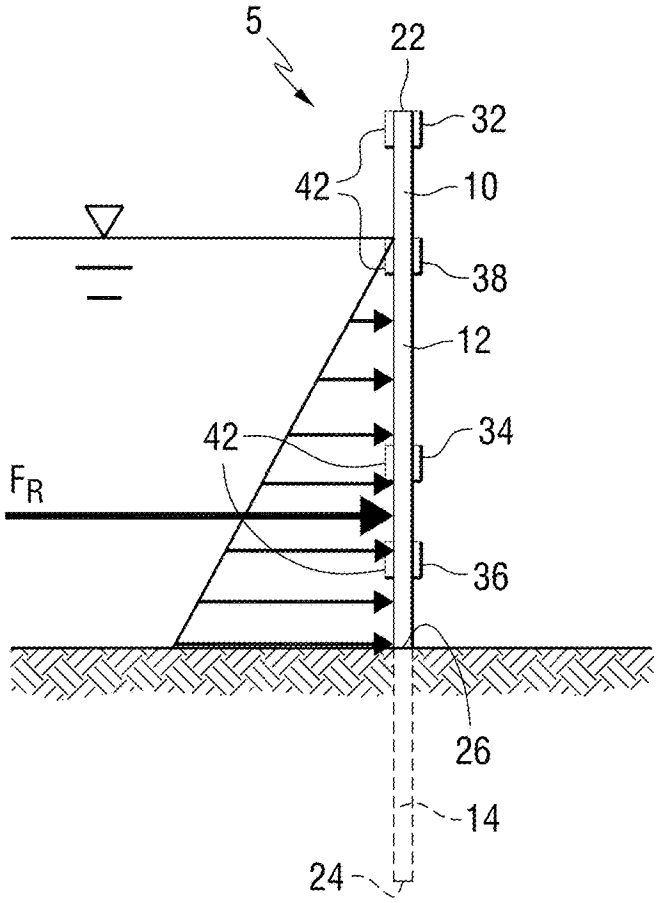
Figure 18:
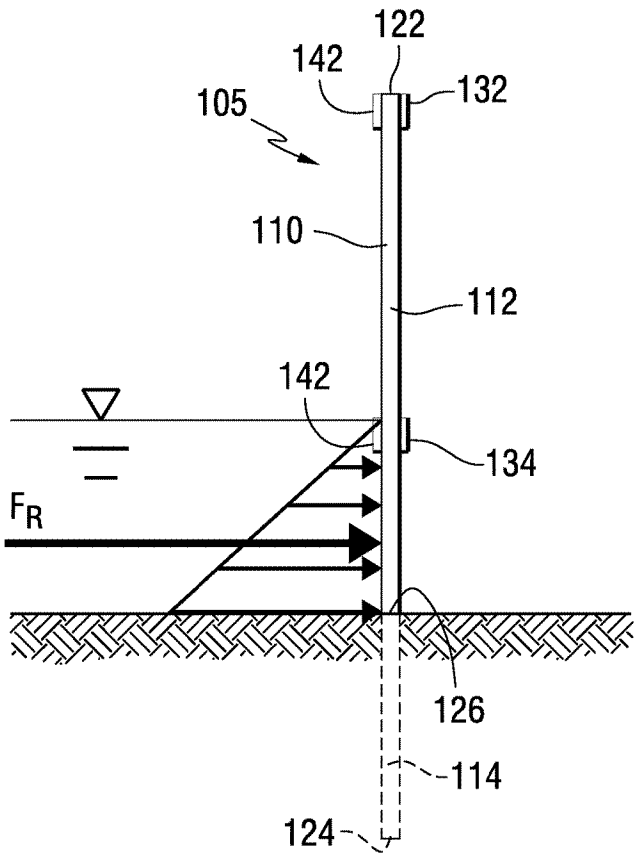
FIGS. 18-22 are partially schematic side views of a sediment-control fence as shown in FIG. 17 including free body diagrams for the hydrostatic and hydrodynamic forces at increasing water levels.

As shown in FIG. 14, at a 24-inch from the ground surface water level, the sediment-control fence 5 experiences certain hydrostatic forces. The sediment-control fence 5 may experience the hydrostatic pressure resultant force $F_R$ at a center of pressure height approximately 8 inches from the lower grade line 26. In certain embodiments, the center of pressure is approximately centered between the primary center of pressure strap 34 and the secondary center of pressure strap 36. The primary center of pressure strap 34 and the secondary center of pressure strap 36 will provide added strength and stiffness to reduce any potential deflection of the sediment-control fence 5.

As shown in FIG. 15, at a 32-inch from the ground surface water level, the sediment-control fence 5 is overtopping and experiences maximum hydrostatic forces. The sediment-control fence 5 may experience hydrostatic pressure resultant force $F_R$ at a center of pressure height approximately 10.7 inches from the lower grade line 26. In certain embodiments, at least a portion of the primary center of pressure strap 34 may be located at the center pressure. The primary center of pressure strap 34 will provide added strength and stiffness to reduce any potential deflection of the sediment-control fence 5.

Figure 16:
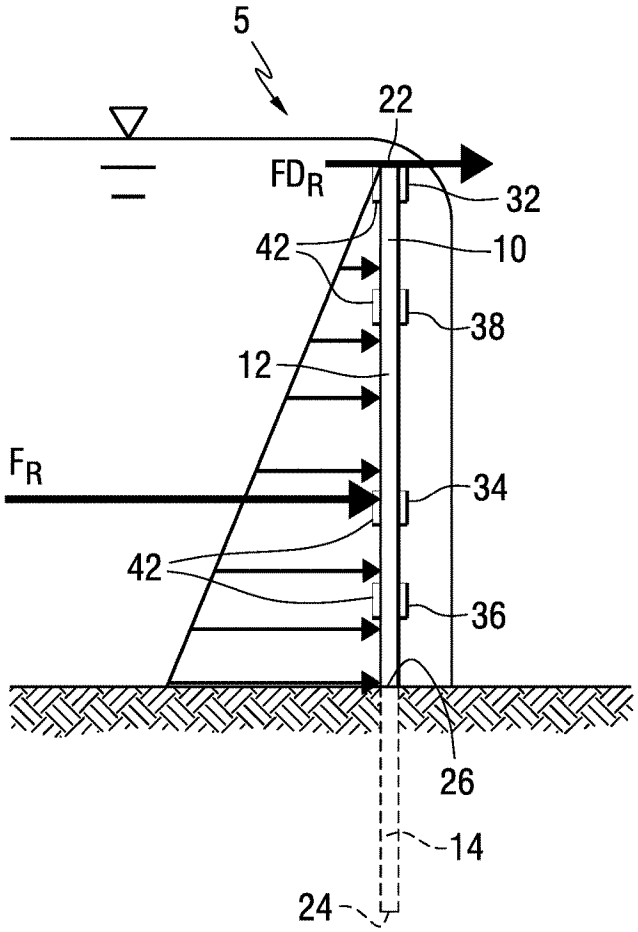

As shown in FIG. 16, at a 34-inch from the ground surface water level, due to overtopping, the sediment-control fence 5 experiences hydrostatic forces and hydrodynamic forces. The sediment-control fence 5 may experience hydrostatic pressure resultant force $F_R$ at a center of pressure height approximately 11.3 inches from the lower grade line 26. In certain embodiments, at least a portion of the primary center of pressure strap 34 may be located at the center of pressure. The primary center of pressure strap 34 will provide added strength and stiffness to reduce any potential deflection of the sediment-control fence 5. The sediment-control fence 5 may additionally experience hydrodynamic resultant force $FD_R$ at the upper edge 22 of the upper portion 12. The overtopping strap 32 and the upper pressure strap 38 provide added strength and stiffness at the top of upper portion 16 to resist excess material deflection and damage of the sediment-control fence 5.

In the embodiment shown in FIG. 12-16, the primary center of pressure strap 34 and the secondary center of pressure strap 36 are located to withstand the fluctuations in the hydrostatic pressure resultant force $F_R$ due to elevated backwater, while the overtopping strap 32 and the upper pressure strap 38 are located to provide reinforcement against hydrodynamic resultant force $FD_R$ developed during overtopping of the sediment-control fence 5.

Figure 17:
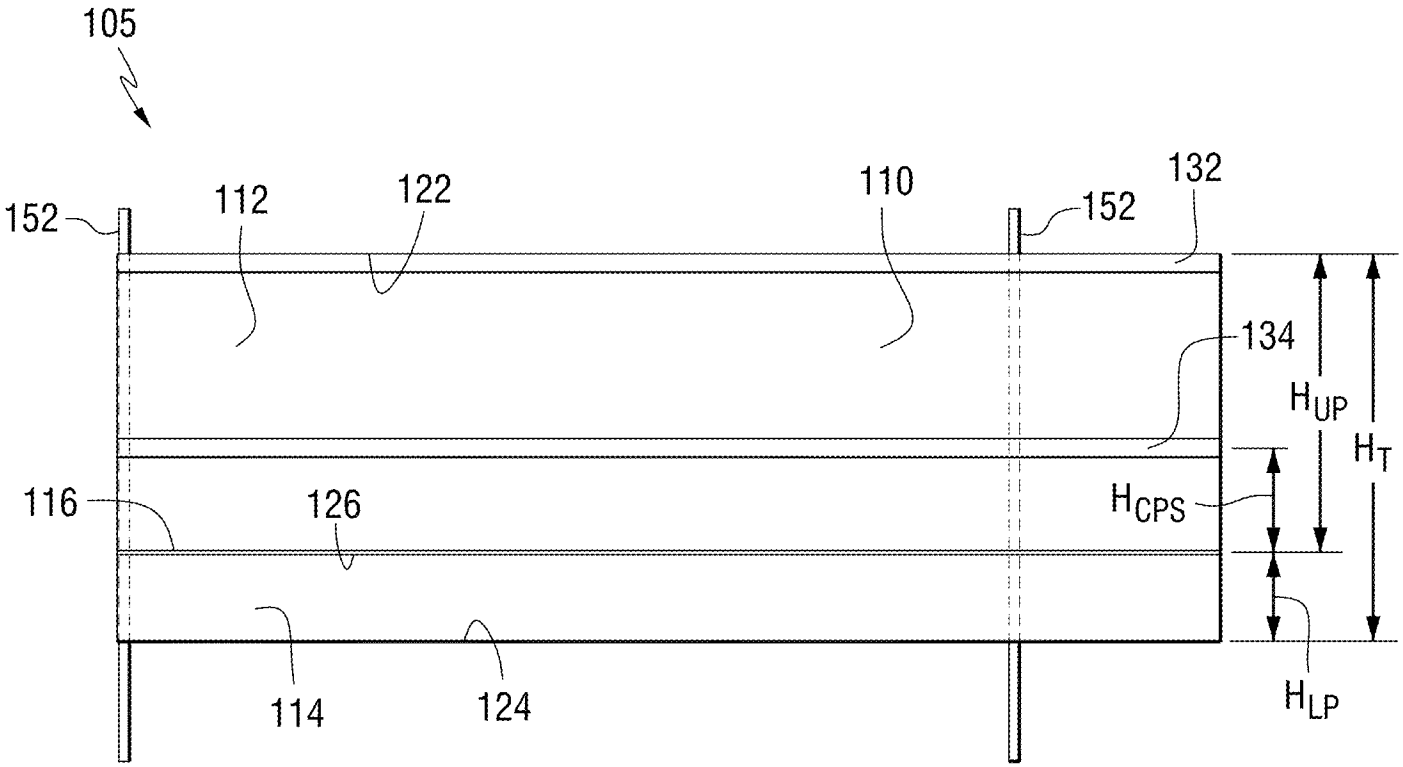
FIG. 17 is a front view of a sediment-control fence in accordance with another embodiment of the present invention.
Figure 20:
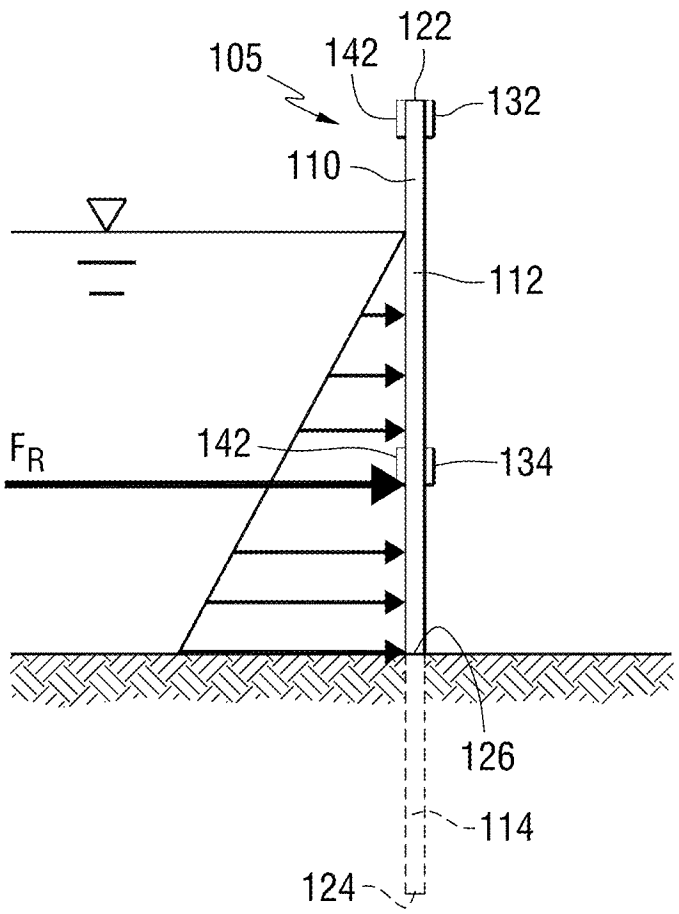
Figure 19:
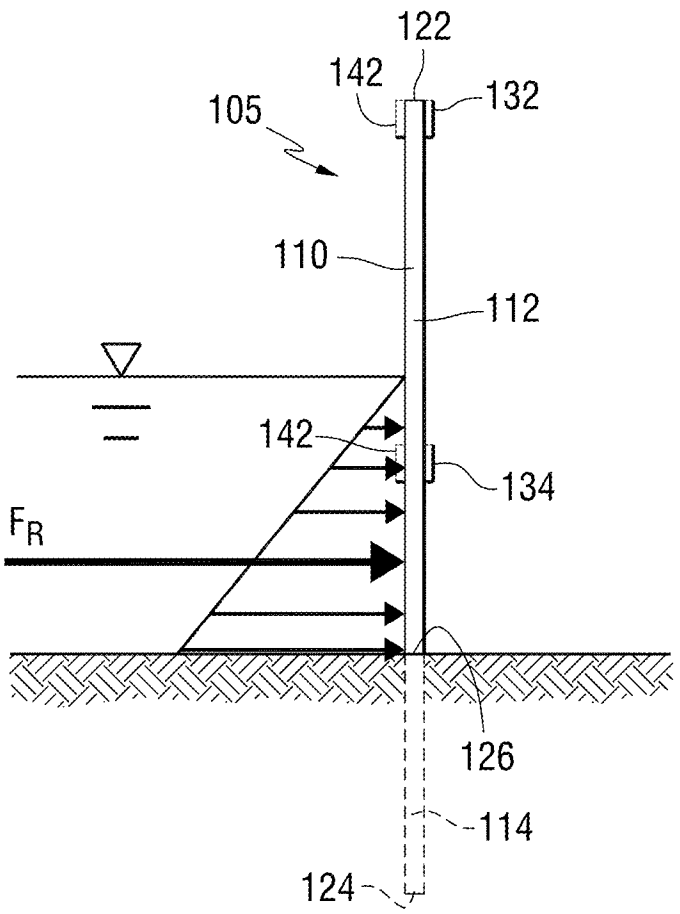
Figure 22:
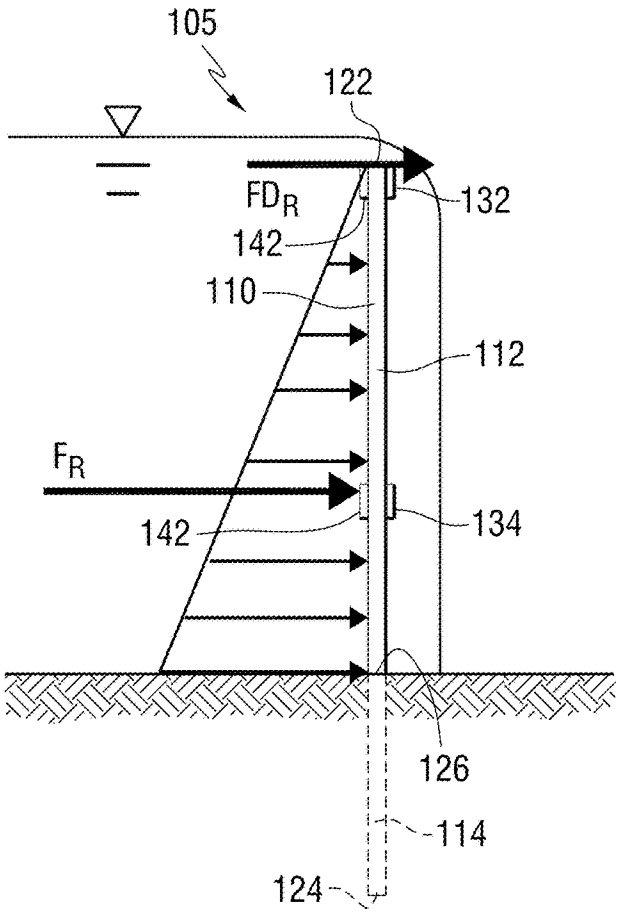
Figure 21:
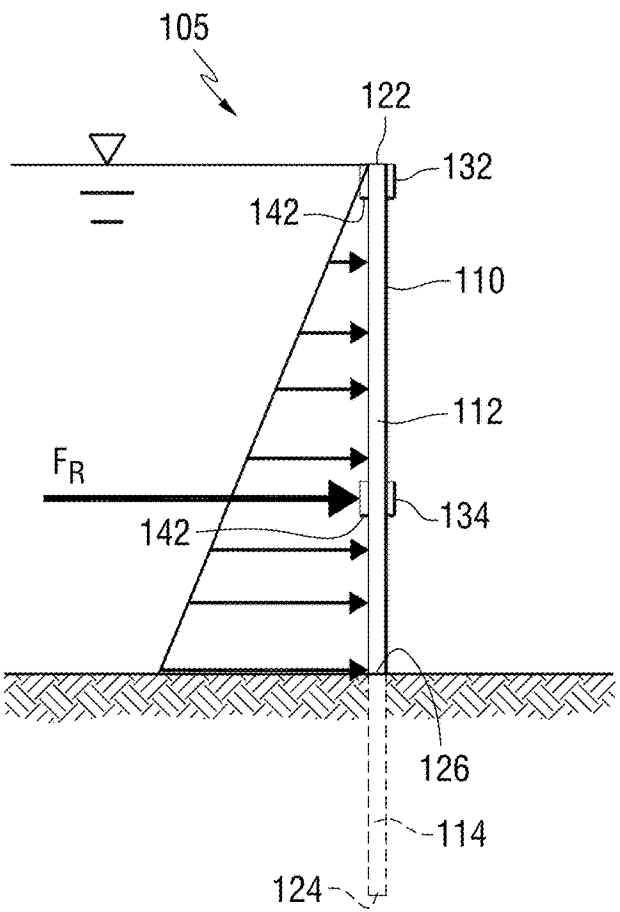

FIGS. 17-22 illustrate a sediment-control fence 105 in accordance with a further embodiment of the present invention. In this embodiment, similar element numbers are used to describe the same features found in the previous embodiment, and the sediment-control fence 105 may be of the same or similar construction as the sediment-control fence 5 described in the previous embodiment. As shown in FIG. 17, a sediment-control fence 105 includes a permeable geotextile material 110 having an upper portion 112, a lower anchoring portion 114 and an anchoring guide line 116. The upper portion 112 has an upper edge 122 and the lower portion 114 has a bottom edge 124. When the lower portion 114 is secured below grade, a lower grade line 126 of the sediment-control fence 105 is formed.

As shown in FIG. 17, the permeable geotextile material 110 of the sediment-control fence 105 has a total height $H_T$, the upper portion 112 has an installed height $H_{UP}$ defined from the lower grade line 126 to the upper edge 122, and the lower portion 114 has a height $H_{LP}$ defined from the lower grad line 126 to the bottom edge 124. The heights may be the same or similar to the $H_T$, $H_{UP}$ and $H_{LP}$ described above in the previous embodiment as shown in FIG. 1.

As shown in FIG. 17, the upper portion 112 of the sediment-control fence 105 may include reinforcing straps 132 and 134 along the fence profile which runs along the length of the sediment-control fence 105 and the permeable geotextile material 110. The reinforcing straps 132 and 134 may be of the same or similar construction as the reinforcing straps 32, 34, 36 and 38 in the embodiment shown in FIGS. 3-7. As shown in FIG. 17, the primary center of pressure strap 134 is located at a height $H_{CPS}$ from the lower grade line 126. The height may be the same or similar to the $H_{CPS}$ described in the previous embodiment as shown in FIG. 1.

In accordance with certain embodiments, when the overtopping strap 132 and the primary center of pressure strap 134 are formed as reinforcing strap pockets they may contain post-tensioning tendons 142. The post-tensioning tendons 142 may be of the same or similar construction as the post-tensioning tendons 42 described in the previous embodiment as shown in FIGS. 4, 6 and 7.

The woven permeable geotextile material 110 of the sediment-control fence 105 may be of the same or similar construction as the permeable geotextile material 10 described in the previous embodiment. Furthermore, the overtopping strap 132 and the primary center of pressure strap 134 may be of the same or similar construction as the reinforcing straps 32, 34, 36 and 38 as described in the previous embodiment.

As shown in FIGS. 17-22, the permeable geotextile material 110 of the sediment-control fence 105 may be secured to the anchoring posts 152 with the fasteners 154. The anchoring posts 152 and the fasteners 154 may be of the same or similar construction as the anchoring posts 52 and the fasteners 54 as described in the previous embodiment.

As shown in FIGS. 18-22, the overtopping strap 132 and the primary center of pressure strap 134 may be included at specific locations along the upper portion 112 height $H_{UP}$ of the sediment-control fence 105 that will encounter elevated hydrostatic and hydrodynamic pressures and forces. The locations of the overtopping strap 132 and the primary center of pressure strap 134 may be of the same or similar to the locations of the overtopping strap 32 and the primary center of pressure strap 34 as described in the previous embodiment.

As schematically shown in FIGS. 18-22, the overtopping strap 132 and the primary of center of pressure strap 134 are formed as reinforcing strap pockets, and may contain post-tensioning tendons 142. As shown in FIGS. 18-22, the sediment-control fence 105 experiences similar hydrostatic and hydrodynamic pressures and forces based on the water level behind the sediment-control fence 5 as described in previous embodiment. The overtopping strap 132 and the primary center of pressure strap 134 are located along the fence height as described in the previous embodiment. The overtopping strap 132 may be located adjacent to the upper edge 122 of the sediment-control fence 105. The height $H_{CPS}$ of the primary center of pressure strap 134 may be located at the height $H_{CP}$ of the center of pressure at overtopping.

In accordance with certain embodiments, the permeable geotextile materials 10 and 110, the overtopping straps 32 and 132, the pressure straps 34, 36, 38 and 134, and the post-tensioning tendons 42 and 142 of the sediment-control fences 5 and 105 may be designed to meet certain minimum specifications, such as minimum average roll values (MARVs). As used herein, the term "minimum average roll value" or "MARV" corresponds to the mean value for a selected property of the sediment-control fence minus two standard deviations. It is to be understood that MARVs individually, and in combination, may be adjusted as desired in order to achieve the desired performance characteristics.

In accordance with certain embodiments, the woven permeable geotextile material of the sediment-control fence may have an ultimate grab tensile strength in the machine direction MARV of greater than 350 lbs, or at least 360 lbs, or at least 380 lbs, or at least 400 lbs, as measured according to the ASTM D4632 standard. The term "ASTM" means American Society for Testing and Materials. The ultimate grab tensile strength in the machine direction MARV measured at a non-reinforced permeable geotextile material portion of the sediment-control fence may typically range from 360 to 3,700 lbs or more, for example, from 380 to 1,500 lbs, or from 400 to 1,000 lbs, as measured according to the ASTM D4632 standard.

In accordance with certain embodiments, the woven permeable geotextile material of the sediment-control fence may have an ultimate grab tensile strength in the transverse direction MARV of at least 370 lbs, or at least 390 lbs, or least 410 lbs, as measured according to the ASTM D4632 standard. The ultimate grab tensile strength in the transverse direction MARV measured at a non-reinforced permeable geotextile material 10 portion of the sediment-control fence may typically range from 370 to 3,700 lbs or more, for example, from 390 to 1,500 lbs, or from 410 to 1,000 lbs, as measured according to the ASTM D4632 standard.

In accordance with certain embodiments, a reinforced portion of the sediment-control fence comprising at least one of the reinforcing straps and the permeable geotextile material may have an ultimate grab tensile strength in the machine direction MARV of at least 400 lbs, or at least 500 lbs, or at least 600 lbs, or at least 650 lbs, as measured according to a modified ASTM D4632 standard. As used herein, the term "modified ASTM D4632" means that ASTM D4632 is modified by centering a reinforcing strap of the sediment-control fence in the clamps of the test grip. The ultimate grab tensile strength in the machine direction MARV measured at one of the reinforcing straps may typically range from 400 to 7,400 lbs or more, for example, from 500 to 3,000 lbs, or from 600 to 2,500 lbs, or from 650 to 2,000 lbs, as measured according to a modified ASTM D4632 standard.

In accordance with certain embodiments, the ultimate grab tensile strength in the machine direction of the reinforced portions of the sediment-control fence is greater than or equal to the ultimate grab tensile strength in the machine direction of the permeable geotextile material. The ultimate grab tensile strength in the machine direction of the reinforced portions of the sediment-control fence comprising at least one reinforcing strap may typically be from 20 to 200 percent or more greater than the ultimate grab tensile strength in the machine direction of the permeable geotextile material, for example, from 40 to 180 percent greater, or from 60 to 160 percent greater.

In accordance with certain embodiments, a reinforced portion of the sediment-control fence comprising the permeable geotextile material, at least one reinforcing strap, and a post-tensioning tendon may have an ultimate grab tensile strength in the machine direction MARV of at least 1,000 lbs, or at least 1,500 lbs, or at least 3,300 lbs, as measured according to a modified ASTM D4632 standard. The ultimate grab tensile strength in the machine direction MARV measured at the reinforced portion of the sediment-control fence comprising the permeable geotextile material, at least one reinforcing strap, and a post-tensioning tendon may typically range from 1,000 to 14,000 lbs or more, for example, from 1,500 to 6,000 lbs, or from 1,800 to 4,000 lbs, as measured according to a modified ASTM D4632 standard.

In accordance with certain embodiments, the woven permeable geotextile material of the sediment-control fence may have an ultimate wide-width tensile strength in the machine direction MARV of at least 1,000 lbs/ft, or at least 2,000 lbs/ft, or least 3,000 lbs/ft, as measured according to the ASTM D4595 standard across the installed height of the permeable geotextile material. The ASTM D4595 test is performed for the installed height of the permeable geotextile material by performing a series of ASTM D4595 tests on 8-inch wide test specimens across the installed height of the permeable geotextile material. The ultimate wide-width tensile strength in the machine direction MARV measured at a non-reinforced permeable geotextile material portion of the sediment-control fence may typically range from 1,000 to 11,000 lbs/ft or more, for example, from 2,000 to 7,000 lbs/ft, or from 3,000 to 9,000 lbs/ft, as measured according to the ASTM D4595 standard across the installed height of the permeable geotextile material.

In accordance with certain embodiments, the woven permeable geotextile material of the sediment-control fence may have an ultimate wide-width tensile strength in the transverse direction MARV of at least 1,000 lbs/ft, or at least 2,000 lbs/ft, or least 3,000 lbs/ft, as measured according to the ASTM D4595 standard across the installed height of the permeable geotextile material. The ultimate wide-width tensile strength in the transverse direction MARV measured for the woven permeable geotextile material of the sediment-control fence may typically range from 1,000 to 11,000 lbs/ft or more, for example, from 2,000 to 7,000 lbs/ft, or from 3,000 to 6,000 lbs/ft, as measured according to the ASTM D4595 standard across the installed height of the permeable geotextile material.

In accordance with certain embodiments such as the embodiment shown in FIG. 1, the sediment-control fence 5 comprising the permeable geotextile material 10 and reinforcing straps 32, 34, 36 and 38 may have an ultimate wide-width tensile strength in the machine direction MARV of at least 1,000 lbs/ft, or at least 2,500 lbs/ft, or least 3,000 lbs/ft, or at least 3,500 lbs/ft, as measured according to the ASTM D4595 standard across the installed height of the sediment-control fence 5. The ASTM D4595 test is performed for the installed height of the sediment-control fence 5 by performing a series of ASTM D4595 tests on 8-inch wide test specimens across the installed height of the sediment-control fence 5. The ultimate wide-width tensile strength in the machine direction MARV measured for the sediment-control fence 5 comprising the permeable geotextile material 10 and reinforcing straps 32, 34, 36 and 38 may typically range from 1,000 to 18,000 lbs/ft or more, for example, from 2,500 to 14,000 lbs/ft, or from 3,000 to 10,000 lbs/ft, as measured according to the ASTM D4595 standard across the installed height of the sediment-control fence 5.

In accordance with certain embodiments, the sediment-control fence 5 comprising the permeable geotextile material 10 and reinforcing straps 32, 34, 36 and 38 may have an ultimate wide-width tensile strength in the transverse direction MARV of at least 1,000 lbs/ft, or at least 2,500 lbs/ft, or least 3,000 lbs/ft, or at least 3,500 lbs/ft, as measured according to the ASTM D4595 standard across the installed height of the sediment-control fence 5. The ultimate wide-width tensile strength in the transverse direction MARV measured for the sediment-control fence 5 comprising the permeable geotextile material 10 and reinforcing straps 32, 34, 36 and 38 may typically range from 1,000 to 18,000 lbs/ft or more, for example, from 2,500 to 14,000 lbs/ft, or from 3,000 to 10,000 lbs/ft, as measured according to the ASTM D4595 standard across the installed height of the sediment-control fence 5.

In accordance with certain embodiments, the sediment-control fence 5 comprising the permeable geotextile material 10, reinforcing straps 32, 34, 36 and 38, and post-tensioning tendons 42 may have an ultimate wide-width tensile strength in the machine direction MARV of at least 1,000 lbs/ft, or at least 4,000 lbs/ft, or least 5,000 lbs/ft, as measured according to the ASTM D4595 standard across the installed height of the sediment-control fence 5. The ASTM D4595 test is performed for the installed height of the sediment-control fence 5 by performing a series of ASTM D4595 tests on 8-inch wide test specimens across the installed height of the sediment-control fence 5. The ultimate wide-width tensile strength in the machine direction MARV measured for the sediment-control fence 5 comprising the permeable geotextile material 10, reinforcing straps 32, 34, 36 and 38, and post-tensioning tendons 42 may typically range from 1,000 to 25,000 lbs/ft or more, for example, from 4,000 to 16,000 lbs/ft, or from 5,000 to 12,000 lbs/ft, as measured according to the ASTM D4595 standard across the installed height of the sediment-control fence 5.

In accordance with certain embodiments, the sediment-control fence 5 comprising the permeable geotextile material 10, reinforcing straps 32, 34, 36 and 38, and tendons 42 may have an ultimate wide-width tensile strength in the transverse direction MARV of at least 1,000 lbs/ft, or at least 4,000 lbs/ft, or least 5,000 lbs/ft, as measured according to the ASTM D4595 standard across the installed height of the sediment-control fence 5. The ultimate wide-width tensile strength in the transverse direction MARV measured for the sediment-control fence 5 comprising the permeable geotextile material 10, reinforcing straps 32, 34, 36 and 38, and tendons 42 may typically range from 1,000 to 25,000 lbs/ft or more, for example, from 4,000 to 16,000 lbs/ft, or from 5,000 to 11,000 lbs/ft, as measured according to the ASTM D4595 standard across the installed height of the sediment-control fence 5.

In accordance with certain embodiments, the sediment-control fence 105 comprising the permeable geotextile material 110, reinforcing straps 132, 134, and tendons 142 may have an ultimate wide-width tensile strength in the machine direction MARV of at least 1,000 lbs/ft, or at least 2,000 lbs/ft, or least 2,500 lbs/ft, as measured according to the ASTM D4595 standard across the installed height of the sediment-control fence 105. The ASTM D4595 test is performed for the installed height of the sediment-control fence 105 by performing a series of ASTM D4595 tests on 8-inch wide test specimens across the installed height of the sediment-control fence 105. The ultimate wide-width tensile strength in the machine direction MARV measured for the sediment-control fence 105 comprising the permeable geotextile material 110, reinforcing straps 132, 134, and tendons 142 may typically range from 1,000 to 10,000 lbs/ft or more, for example, from 2,000 to 6,500 lbs/ft, or from 2,500 to 5,000 lbs/ft, as measured according to the ASTM D4595 standard across the installed height of the sediment-control fence 105.

In accordance with certain embodiments, the sediment-control fence 105 comprising the permeable geotextile material 110, reinforcing straps 132, 134, and tendons 142 may have an ultimate wide-width tensile strength in the transverse direction MARV of at least 1,000 lbs/ft, or at least 1,500 lbs/ft, or least 2,000 lbs/ft, as measured according to the ASTM D4595 standard across the installed height of the sediment-control fence 105. The ultimate wide-width tensile strength in the transverse direction MARV measured for the sediment-control fence 105 comprising the permeable geotextile material 110, reinforcing straps 132, 134, and tendons 142 may typically range from 1,000 to 10,000 lbs/ft or more, for example, from 1,500 to 6,500 lbs/ft, or from 2,700 to 11,000 lbs/ft, as measured according to ASTM D4595 across the installed height of the sediment-control fence 105.

In accordance with certain embodiments, a reinforced portion of the sediment-control fence 5 comprising the permeable geotextile material 10 and a combination of any two reinforcing straps such as 32, 34, 36 and 38 may have a may have an 8-inch ultimate wide-width tensile strength in the machine direction MARV of at least 1,000 lbs/ft, or at least 2,000 lbs/ft, or least 3,000 lbs/ft, or at least 3,500 lbs/ft, as measured according to the ASTM D4595 standard. For example, the reinforced portion of the sediment-control fence 5 comprising the permeable geotextile material 10 and the reinforcing straps 34 and 36 may have an 8-inch ultimate wide-width tensile strength in the machine direction MARV of at least 1,000 lbs/ft, or at least 2,000 lbs/ft, or least 3,000 lbs/ft, as measured according to the ASTM D4595 standard. The 8-inch ultimate wide-width tensile strength in the machine direction MARV measured at the reinforced portion of the sediment-control fence 5 comprising the permeable geotextile material 10 and a combination of any two reinforcing straps such as 32, 34, 36 and 38 may typically range from 1,000 to 14,000 lbs/ft or more, for example, from 2,000 to 9,100 lbs/ft, or from 3,000 to 7,800 lbs/ft, as measured according to the ASTM D4595 standard.

In accordance with certain embodiments, a reinforced portion of the sediment-control fence 5 comprising the permeable geotextile material 10, a combination of any two reinforcing straps such as 32, 34, 36 and 38, and tendons 42 may have an 8-inch ultimate wide-width tensile strength in the machine direction MARV of at least 1,000 lbs/ft, or at least 2,500 lbs/ft, or least 3,500 lbs/ft, or at least 4,000 lbs/ft, as measured according to the ASTM D4595 standard. For example, the reinforced portion of the sediment-control fence 5 comprising the permeable geotextile material 10, reinforcing straps 34 and 36, and tendons 42 may have an 8-inch ultimate wide-width tensile strength in the machine direction MARV of at least 1,000 lbs/ft, or at least 2,500 lbs/ft, or least 3,500 lbs/ft, as measured according to the ASTM D4595 standard. The 8-inch ultimate wide-width tensile strength in the machine direction MARV measured at the reinforced portion of the sediment-control fence 5 comprising the permeable geotextile material 10, a combination of any two reinforcing straps such as 32, 34, 36 and 38, and tendons 42 may typically range from 1,000 to 25,000 lbs/ft or more, for example, from 2,500 to 16,000 lbs/ft, or from 3,500 to 11,000 lbs/ft, as measured according to the ASTM D4595 standard.

In accordance with certain embodiments, a reinforced portion of the sediment-control fence 105 comprising the permeable geotextile material 110, at least one of strap 132, 134, and a tendon 142 may have an 8-inch ultimate wide-width tensile strength in the machine direction MARV of at least 1,000 lbs/ft, or at least 1,500 lbs/ft, or least 2,500 lbs/ft, as measured according to the ASTM D4595 standard. The 8-inch ultimate wide-width tensile strength in the machine direction MARV measured for the reinforced portion of the sediment-control fence 105 comprising the permeable geotextile material 110, at least one of strap 132, 134, and a tendon 142 may typically range from 1,000 to 10,000 lbs/ft or more, for example, from 1,500 to 6,500 lbs/ft, or from 2,500 to 5,000 lbs/ft, as measured according to the ASTM D4595 standard.

In accordance with certain embodiments, the woven permeable geotextile material of the sediment-control fence may have a modulus in the machine and transverse directions of at least 500 lbs/ft, or at least 3,000 lbs/ft, or least 4,000 lbs/ft, as measured according to the ASTM D4595 standard, which provides both the material ultimate tensile strength and elongation (i.e., strain), and using the calculation for modulus. As used herein, the term "calculation for modulus" means taking the ultimate tensile strength of the material (force units) and dividing the ultimate tensile strength by the elongation (using the decimal value of the % elongation). The modulus in the machine and transverse directions measured at a non-reinforced permeable geotextile material portion of the sediment-control fence may typically range from 500 to 40,000 lbs/ft or more, for example, from 3,000 to 35,000 lbs/ft, or from 4,000 to 25,000 lbs/ft, as measured according to the ASTM D4595 standard and using the calculation for modulus.

In accordance with certain embodiments, a reinforced portion of the sediment-control fence 5 comprising the permeable geotextile material 10 and a combination of any two reinforcing straps such as 32, 34, 36 and 38 may have a modulus in the machine direction of at least 600 lbs/ft, or at least 4,000 lbs/ft, or least 5,500 lbs/ft, as measured according to the ASTM D4595 standard and using the calculation for modulus. For example, the reinforced portion of the sediment-control fence 5 comprising the permeable geotextile material 10 and reinforcing straps 34, 36, may have a modulus of at least 600 lbs/ft, or at least 4,000 lbs/ft, or least 5,000 lbs/ft, as measured according to the ASTM D4595 standard and using the calculation for modulus. The modulus measured at a reinforced portion of the sediment-control fence may typically range from 600 to 55,000 lbs/ft or more, for example, from 4,000 to 45,000 lbs/ft, or from 5,000 to 35,000 lbs/ft, as measured according to the ASTM D4595 standard and using the calculation for modulus.

In accordance with certain embodiments, a reinforced portion of the sediment-control fence 5 comprising the permeable geotextile material 10, a combination of any two reinforcing straps such as 32, 34, 36 and 38, and tendons 42 may have a modulus in the machine direction of at least 1,000 lbs/ft, or at least 4,000 lbs/ft, or least 5,500 lbs/ft, as measured according to the ASTM D4595 standard and using the calculation for modulus. For example, the reinforced portion of the sediment-control fence 5 comprising the permeable geotextile material 10, reinforcing straps 34, 36, and tendons 42 may have a modulus in the machine direction of at least 1,000 lbs/ft, or at least 4,000 lbs/ft, or least 5,500 lbs/ft, as measured according to the ASTM D4595 standard and using the calculation for modulus. The modulus in the machine direction measured at a reinforced portion of the sediment-control fence comprising the permeable geotextile 10, at least one strap 32, 34, 36 and 38, and a tendon 42 may typically range from 1,000 to 60,000 lbs/ft or more, for example, from 4,000 to 50,000 lbs/ft, or from 5,500 to 40,000 lbs/ft, as measured according to the ASTMD4595 standard and using the calculation for modulus.

In accordance with certain embodiments, the modulus of the reinforced portions of the sediment-control fence in the machine direction is greater than or equal to the modulus of the permeable geotextile material. The modulus of the reinforced portions of the sediment-control fence may be from 10 to 500 percent or more greater than the modulus of the permeable geotextile material, for example, from 100 to 400 percent, or from 150 to 300 percent.

In accordance with certain embodiments, the sediment-control fence 5 comprising the permeable geotextile material 10, reinforcing straps 32, 34, 36 and 38, and tendons 42 may have an overall stiffness, i.e., modulus in the machine and transverse directions that is greater than the stiffness of the permeable geotextile material 10. For example, the sediment-control fence 5 may have an overall modulus in the machine and transverse directions that is at least 1,500 lbs/ft, or at least 4,500 lbs/ft, or at least 6,000 lbs/ft, as measured according to the ASTM D4595 standard across the installed height of the sediment-control fence 5 and using the calculation for modulus. The overall modulus in the machine and transverse directions of the sediment-control fence 5 comprising the permeable geotextile material 10, reinforcing straps 32, 34, 36 and 38, and tendons 42 may typically range from 1,500 to 150,000 lbs/ft or more, for example, from 4,500 to 90,000 lbs/ft, or from 6,000 to 70,000 lbs/ft, as measured according to the ASTM D4595 standard across the installed height of the sediment-control fence 5 and using the calculation for modulus.

In accordance with certain embodiments, the sediment-control fence 105 comprising the permeable geotextile material 110, reinforcing straps 132, 134, and tendons 142 may have an overall stiffness, i.e., modulus in the machine and transverse directions that is greater than the stiffness of the permeable geotextile material 110. For example, the sediment-control fence 105 may have an overall modulus in the machine and transverse directions that is at least 1,500 lbs/ft, or at least 2,000 lbs/ft, or at least 3,000 lbs/ft, as measured according to the ASTM D4595 standard across the installed height of the sediment-control fence 105 and using the calculation for modulus. The overall modulus in the machine and transverse directions of the sediment-control fence 105 comprising the permeable geotextile material 110, reinforcing straps 132, 134, and tendons 142 may typically range from 1,500 to 60,000 lbs/ft or more, for example, from 2,000 to 30,000 lbs/ft, or from 3,000 to 15,000 lbs/ft, as measured according to the ASTM D4595 standard across the installed height of the sediment-control fence 105 and using the calculation for modulus.

In accordance with certain embodiments, the woven permeable geotextile material of the sediment-control fence may have an apparent opening size, a flux and a permittivity. For example, the apparent opening size MARV of the woven permeable geotextile material may be from No. 30 (0.6 mm) to No. 200 Sieve (0.075 mm), or from No. 40 (0.425 mm) to No. 120 Sieve (0.125 mm), or from No. 50 (0.3 mm) to No. 70 Sieve (0.212 mm), as measured according to the ASTM D4751 standard. The clean-water flux MARV of the woven permeable geotextile material may be from 10 to 225 gpm/ft$^2$ or more, or from 50 to 150 gpm/ft$^2$, or from 70 to 125 gpm/ft$^2$, as measured according to the ASTM D4491 standard. The permittivity MARV of the woven permeable geotextile material may be from 0.1 to 3.0 sec$^{-1}$ or more, or from 0.75 to 2.0 sec$^{-1}$, or from 0.9 to 1.5 sec$^{-1}$, as measured according to the ASTM D4491 standard.

In accordance with certain embodiments, the permeable geotextile material of the sediment-control fence may have a substantially consistent apparent opening size, clean-water flux and permittivity along the upper portion height $H_{UP}$ of sediment-control fence. This results in a single rate of water flow through the permeable geotextile material of the sediment-control fence.

In accordance with certain embodiments, the woven permeable geotextile material of the sediment-control fence may have a CBR puncture MARV of at least 200 lbs, or at least 600 lbs, or at least 800 lbs, as measured according to the ASTM D6241 standard. The term "CBR" means California Bearing Ratio. The CBR puncture MARV measured at a non-reinforced permeable geotextile material portion of the sediment-control fence may typically range from 200 to 4,000 lbs or more, for example, from 600 to 3,500 lbs, or from 800 to 3,000 lbs, as measured according to the ASTM D6241 standard.

In accordance with certain embodiments, the woven permeable geotextile material of the sediment-control fence may have a trapezoidal tear in the machine direction MARV of at least 50 lbs, or at least 75 lbs, or at least 120 lbs, as measured according to the ASTM D4533 standard. The trapezoidal tear in the machine direction MARV measured at a non-reinforced permeable geotextile material portion of the sediment-control fence may typically range from 50 to 1,000 lbs or more, for example, from 75 to 800 lbs, or from 120 to 500 lbs, as measured according to the ASTM D4533 standard.

In accordance with certain embodiments, the woven permeable geotextile material of the sediment-control fence may have a trapezoidal tear in the transverse direction MARV of at least 50 lbs, or at least 75 lbs, or at least 120 lbs, as measured according to the ASTM D4533 standard. The trapezoidal tear in the transverse direction MARV measured at a non-reinforced permeable geotextile material portion of the sediment-control fence may typically range from 50 to 1,000 lbs or more, for example, from 75 to 800 lbs, or from 120 to 500 lbs, as measured according to the ASTM D4533 standard.

In accordance with certain embodiments, the woven permeable geotextile material of the sediment-control fence may have a mullen burst MARV of at least 200 psi, or at least 500 psi, or at least 600 psi, as measured according to the ASTM D3786 standard. The mullen burst MARV measured at a non-reinforced permeable geotextile material 10 portion of the sediment-control fence may typically range from 200 to 2,500 psi or more, for example, from 500 to 2,000 psi, or from 600 to 1,500 psi, as measured according to the ASTM D3786 standard.

In accordance with certain embodiments, the woven permeable geotextile material of the sediment-control fence may have an UV stability MARV of at least 90 percent tensile strength retained in the machine direction, or at least 95 percent tensile strength retained in the machine direction, or at least 98 percent tensile strength retained in the machine direction, as measured according to the ASTM D4355 standard. The UV stability MARV measured at a non-reinforced permeable geotextile material portion of the sediment-control fence may typically range from 90 to 100 percent tensile strength retained in the machine direction, for example, from 95 to 100 percent tensile strength retained in the machine direction, or from 98 to 100 percent tensile strength retained in the machine direction, as measured according to the ASTM D4355 standard.

Table 1 below lists MARV ranges for a permeable geotextile material 10, and for reinforced portions of a sediment-control fence 5 including reinforcing strap pockets 32, 34, 36 and 38 and post-tensioning tendons 42 in accordance with an embodiment of the present invention.

TABLE 1

| Material Properties | |
|---|---|
| Test Method | Minimum Average Roll Values |
| Material Properties for Permeable Geotextile Material (excluding reinforcing straps and post-tensioning tendons) | |
| MD and TD Base Fabric Wide Width Tensile - Ultimate (ASTM D4595) | 1,000 to 11,000 lbs/ft |

TABLE 1-continued

| Material Properties | |
|---|---|
| Test Method | Minimum Average Roll Values |
| MD Base Fabric Grab Tensile Strength - Ultimate (ASTM D4632) | (360 to 3,700 lbs)-MD × (451 to 3,700 lbs)-TD |
| Base Fabric CBR Puncture (ASTM D6241) | 200 to 4,000 lbs |
| Base Fabric Trapezoidal Tear (ASTM D4533) | (50 to 1,000 lbs)-MD × (50 to 1,000 lbs)-TD |
| Base Fabric Mullen Burst (ASTM D3786) | 200 to 2,500 psi |
| Base Fabric UV Stability (ASTM D4355) | 90% to 100% Tensile Strength Retained |
| *Material Properties for Entire Reinforced Fence | |
| MD Ultimate Wide-Width Tensile Strength Across Entire Installed Height/Width of Reinforced Fence System (Based on a Series of ASTM D4595 tests) | 1,000 to 25,000 lbs/ft-MD |
| MD 8-inch Ultimate Wide-Width Tensile Strength with 2 Reinforcing Tendons Included (ASTM D4595) | 1,000 to 25,000 lbs/ft-MD |
| TD 8-inch Ultimate Wide-Width Tensile Strength including All Reinforcement Tendons Across Entire TD Height of Fence (ASTM D4595) | 1,000 to 25,000 lbs/ft TD |
| Elongation of Reinforced Fence Including Tensioning Chords and Straps (ASTM D4595) | 1% to 30% – MD × 1% to 30% – TD |

*Reinforced fence testing includes synergistic strength properties of permeable geotextile material and reinforcing straps w/post-tensioning tendons together
MD = Machine Direction;
TD = Transverse Direction Table 2 below lists MARVs for a permeable geotextile material 110, and for reinforced portions of a sediment-control fence 105 including reinforcing strap pockets 132, and 134, and post-tensioning tendons 142 in accordance with an embodiment of the present invention.

In accordance with certain embodiments, the sediment-control fence 5, 105 may be installed according to the following process. A trench having a width and depth may be excavated. For example, the trench width (not shown) may be from about 2 to 8 inches, and the trench depth (not shown) may be from 2 to 12 inches. A plurality of anchoring

TABLE 2

| Material Properties | |
|---|---|
| Test Method | Minimum Average Roll Values (MARVs) |
| Material Properties for Permeable geotextile Material (excluding reinforcing straps and post-tensioning tendons) | |
| MD and TD Base Fabric Wide Width Tensile - Ultimate (ASTM D4595) | 1,000 to 11,000 lbs/ft |
| MD Base Fabric Grab Tensile Strength - Ultimate (ASTM D4632) | (360 to 3,700 lbs)-MD × (451 to 3,700 lbs)-TD |
| Base Fabric CBR Puncture (ASTM D6241) | 200 to 4,000 lbs |
| Base Fabric Trapezoidal Tear (ASTM D4533) | (50 to 1,000 lbs)-MD × (50 to 1,000 lbs)-TD |
| Base Fabric Mullen Burst (ASTM D3786) | 200 to 2,500 psi |
| Base Fabric UV Stability (ASTM D4355) | 90% to 100% Tensile Strength Retained |
| *Material Properties for Entire Reinforced Fence | |
| MD Ultimate Wide-Width Tensile Strength Across Entire Height/Width of Reinforced Fence System (Based on a Series of ASTM D4595 tests) | 1,000 to 10,000 lbs/ft |
| MD 8-inch Ultimate Wide Width Tensile Strength with 2 Reinforcing Tendons Included (ASTM D4595) | 1,000 to 10,000 lbs/ft |
| TD 8-inch Ultimate Wide Width Tensile Strength including All Reinforcement Tendons Across Entire TD Height of Fence (ASTM D4595) | 1,000 to 10,000 lbs/ft |
| Elongation of Reinforced Fence Including Tensioning Chords and Straps (ASTM D4595) | 1% to 30% – MD × 1% to 30% – TD |

*Reinforced fence testing includes synergistic strength properties of permeable geotextile material and reinforcing straps w/post-tensioning tendons together
MD = Machine Direction;
TD = Transverse Direction posts 52, 152 having a distance apart may then be driven into the trench. For example, distance between anchoring posts may range from 2 to 20 feet, or from 3 to 15 feet, or from 4 to 10 feet. The sediment-control fence 5, 105 may then be laid out along the trench with the first end next to a first anchoring post 52, 152 and the second end next to the end anchoring post 52, 152. The bottom portion 14, 114 of the sediment-control fence 5, 105 is then placed in the trench. In a certain embodiment, after the bottom portion 14, 114 of the sediment-control fence 5, 105 is placed in the trench, the anchoring guide line 16 intersects the ground surface. Sediment-control fence 5, 105 may then be attached to the first anchoring post 52, 152. In certain embodiments, a first end of the post-tensioning tendons 42, 142 may be secured to the first anchoring post 52, 152. However, the sediment-control fence 5, 105 may not include post-tensioning tendons 42, 142. Sediment-control fence 5, 105 may then be pulled tight in the direction of the adjacent anchoring post 52, 152 in preparation for attaching the fence to the anchoring post. Sediment-control fence 5, 105 may then be attached to the adjacent anchoring post 52, 152. This attachment process may then be repeated for every anchoring post 52, 152 until the end anchoring post 52, 152 is reached. Sediment-control fence 5, 105 may then be attached to the end anchoring post 52, 152. In certain embodiments, a second end of the post-tensioning tendons 42, 142 may be secured to the end anchoring post 52, 152. However, the sediment-control fence 5, 105 may not include post-tensioning tendons 42, 142, as previously discussed.

In accordance with certain embodiments, the sediment-control fence 5, 105 may be secured to the anchoring post 52, 152 according to the following process. A fastener 54 is inserted through one of the reinforcing straps 32, 34, 36 and 38, 132, 134 of the sediment-control fence 5, 105 using any suitable means and passed around the anchoring post 52, 152 mounted in the ground. In accordance with another embodiment of the present invention, the fastener 54, 154 may be inserted through the sediment-control fence at any height along the upper portion 12, 112 height $H_{UP}$ of the sediment-control fence 5, 105. A fixture (not shown) with two holes may then mounted to the legs of the fastener 54, 154 and rotated by a hand tool to secure the fastener 54, 154 around the anchoring post 52, 152. Alternatively, any other suitable type of hand operated tool or power tool may be included, such as a power drill with a rotatable fixture. In accordance with certain embodiments, this process is then repeated with at a second fastener 54, 154 at a second strap 32, 34, 36 and 38, 132, 134. Alternatively, the second fastener 54, 154 may be inserted through the sediment-control fence 5, 105 at any height along the upper portion 12, 112 height $H_{UP}$ of the sediment-control fence 5, 105. In addition, the process may be repeated for additional fasteners 54, 154 are additional locations.

In accordance with certain embodiments, post-tensioning of the sediment-control fence 5, 105 may be performed after the trench and anchoring posts 52, 152 have been installed in the field. The first end portion of the post-tensioning tendons 42, 142 may be manually wrapped around a first installed anchoring post 52, 152 and double-tied to the anchoring post 52, 152. Alternatively, post-tensioning may be performed prior to anchoring the first anchoring post 52, 152 into the ground. Next, the tendons 42, 142 may be pulled taut across a length of 10 feet to 20 feet of the tendons 42 and secured to a pre-installed anchoring post. This tensioning process may be repeated for every 10 to 20 feet of the tendons 42, 142 until the end anchoring post 52, 152 is reached. The sediment-control fence 5, 105 may comprise vertical slits positioned every 4 to 10 feet to provide access to the post-tensioning tendons 42, 142 in order to pull the tendons partially out of the reinforcing strap pockets 32, 34, 36 and 38, 132, 134 and loop the tendons 42, 142 around each anchoring post 52, 152. The second end portion of the post-tensioning tendons 42, 142 may be manually wrapped around the end anchoring post of the fence and double-tied to the post.

In accordance with a further embodiment of the present invention, post-tensioning may be performed prior to driving the first anchoring post 52, 152 into the ground. The sediment-control fence 5, 105 may be secured to the first anchoring post 52, 152 by rotating the first post several times, wrapping the sediment-control fence 5, 105 tightly around the first anchoring post 52, 152. The first anchoring post 52, 152 may then be driven into the trench. Next, the tendons 42, 142 may be pulled taut across a length of 10 feet to 20 feet of the tendons 42, 142 and secured to a pre-installed anchoring post 52, 152. This tensioning process may be repeated for every 10 to 20 feet of the tendons 42, 142 until the end anchoring post 52, 152 is reached. The sediment-control fence 5, 105 may be secured to the end anchoring post 52, 152 by rotating the end anchoring post 52, 152 several times, wrapping the sediment-control fence 5, 105 tightly around the end anchoring post 52, 152 prior to driving the end anchoring post 52, 152 into the ground. The end anchoring post 52, 152 may then be driven into the trench.

The following example is intended to illustrate various aspects of the present invention, and is not intended to limit the scope of the invention.

EXAMPLE

A sediment-control fence similar to that shown in FIG. 1 was made as follows. The permeable geotextile material was made from polypropylene monofilaments having a denier of 1,000 that were loaded into a loom in the machine (warp) and transverse (fill, cross or weft) directions. The polypropylene monofilaments were then woven using a plain weave to form the permeable geotextile material portion of the fence. The reinforcing strap portions of the fence were made from polypropylene monofilaments having a denier of 1,100 that were loaded into the loom in the machine (warp) direction, while maintaining the 1,000 denier monofilaments in the transverse (fill, cross or weft) direction. The polypropylene monofilaments were then woven using a plain weave to form the reinforcing straps in regions adjacent to the woven permeable geotextile material. An additional layer of such reinforcing material was woven and then stitched to the permeable geotextile material over the reinforcing straps to form the overtopping strap and the primary center of pressure strap with reinforcing pockets. Testing was conducted in accordance with the standardized ASTM test procedures listed in Table 3 below. The measured Minimum Average Roll Values (MARVs) of the sediment-control fence are shown in Table 3.

TABLE 3

| Test Method | Minimum Average Roll Values (MARVs) |
|---|---|
| Mean Grab Tensile Strength (ASTM D4632) - Permeable Geotextile Material | 407 lbs (MD) |

TABLE 3-continued

| Test Method | Minimum Average Roll Values (MARVs) |
|---|---|
| Mean Grab Tensile Strength (modified ASTM D4632) - Reinforced Fence* | 676 lbs (MD) |
| CBR Puncture (ASTM D6241) - Permeable Geotextile Material | 832 lbs |
| Mullen Burst (ASTM D3786) - Permeable Geotextile Material | 522 psi |
| Trapezoidal Tear (ASTM D4533) - Permeable Geotextile Material | 133 lbs (MD) × 111 lbs (**TD) |
| Apparent Opening Size (ASTM D4751) - Permeable Geotextile Material | Sieve No. 40-70 (0.425-0.212 mm) |
| Clean-Water Flux (ASTM D4491) - Permeable Geotextile Material | 75 gpm/ft$^2$ |

*Reinforced fence testing includes synergistic strength properties of the permeable geotextile material and reinforcing strap
MD = Machine Direction;
TD = Transverse Direction Whereas particular embodiments of this invention have been described above for purposes of illustration, it will be evident to those skilled in the art that numerous variations of the details of the present invention may be made without departing from the invention as defined in the appended claims.

What is claimed is:

1. A sediment-control fence comprising:

a permeable geotextile material comprising a woven fabric having a lower grade line and an upper edge defining an installed height extending between the lower grade line and the upper edge, and having a substantially consistent apparent opening size along the installed height;

an overtopping strap adjacent to the upper edge of the permeable geotextile material; and a primary center of pressure strap having a width running along a length of the permeable geotextile material at a height between the lower grade line and the upper edge corresponding to a height of the center of pressure at overtopping, and wherein the height of the center of pressure at overtopping falls within the width of the primary center of pressure strap.

2. The sediment-control fence of claim 1, wherein the height of the center of pressure at overtopping is equal to the height of the primary center of pressure strap measured at a midpoint of the width of the primary center of pressure strap.

3. The sediment-control fence of claim 1, wherein the height of the primary center of pressure strap measured at a midpoint of the width of the primary center of pressure strap is from 32 to 35 percent of the installed height.

4. The sediment-control fence of claim 1, wherein the sediment-control fence further comprises a secondary center of pressure strap running along the length of the permeable geotextile material at a height corresponding to a height of the center of pressure at half overtopping.

5. The sediment-control fence of claim 4, wherein the height of the center of pressure at half overtopping falls within a width of the secondary center of pressure strap.

6. The sediment-control fence of claim 5, wherein the height of the center of pressure at half overtopping is equal to the height of the secondary center of pressure strap measured at a midpoint of the width of the secondary center of pressure strap.

7. The sediment-control fence of claim 4, wherein the height of the secondary center of pressure strap measured at a midpoint of the width of the secondary center of pressure strap is from 15 to 18 percent of the installed height.

8. The sediment-control fence of claim 4, wherein the sediment-control fence has an 8-inch ultimate wide width tensile strength in the machine direction of greater than 1,000 lbs/ft MARV as measured according to ASTM D4595 at the primary center of pressure strap and the secondary center of pressure strap.

9. The sediment-control fence of claim 8, wherein the sediment-control fence has a modulus greater than 600 lbs/ft MARV as measured according to ASTM D4595 at the primary center of pressure strap and the secondary center of pressure strap.

10. The sediment-control fence of claim 1, wherein the sediment-control fence further comprises an upper pressure strap running along the length of the permeable geotextile material at a height above a midpoint between the overtopping strap and the primary center of pressure strap.

11. The sediment-control fence of claim 10, wherein the height of the upper pressure strap measured at a midpoint of a width of the upper pressure strap is from 70 to 74 percent of the installed height.

12. The sediment-control fence of claim 1, wherein the primary center of pressure strap comprises a two-ply woven material comprising two fabric layers.

13. The sediment-control fence of claim 12, wherein a first one of the fabric layers comprises a first set of weft filaments running in a transverse direction, and a first set of warp filaments running in a machine direction, and a second one of the fabric layers comprises a second set of weft filaments running in the transverse direction, and a second set of warp filaments running in the machine direction.

14. The sediment-control fence of claim 13, wherein the first set of weft filaments and the second set of weft filaments extend into the permeable geotextile material, and the permeable geotextile material comprises a set of geotextile warp filaments running in the machine direction, wherein the set of geotextile warp filaments is woven with the first set of weft filaments and the second set of weft filaments using a plain weave.

15. The sediment-control fence of claim 1, wherein the primary center of pressure strap has a first side and a second side forming a pocket therebetween.

16. The sediment-control fence of claim 15, further comprising a post-tensioning tendon in the pocket of the primary center of pressure strap.

17. The sediment-control fence of claim 1, further comprising:

a secondary center of pressure strap running along the length of the permeable geotextile material at a height below the primary center of pressure strap; and an upper pressure strap running along the length of the permeable geotextile material a height between the overtopping strap and the primary center of pressure strap, wherein the overtopping strap, primary center of pressure strap, secondary center of pressure strap and the upper pressure strap have widths of from 1 to 3 inches.

18. The sediment-control fence of claim 17, wherein the secondary center of pressure strap and the upper pressure strap comprise a two-ply woven material comprising two fabric layers.

19. The sediment-control fence of claim 17, wherein the secondary center of pressure strap has a first side and a second side forming a pocket therebetween, and the upper pressure strap has a first side and a second side forming a pocket therebetween.

20. The sediment-control fence of claim 19, wherein at least one of the pocket of the secondary center of pressure strap and the pocket of the upper pressure strap comprise a post-tensioning tendon therein.

21. The sediment-control fence of claim 1, wherein the overtopping strap comprises a woven material having a first side and a second side forming a pocket therebetween, and a post-tensioning tendon contained in the pocket.

22. The sediment-control fence of claim 1, wherein the woven fabric of the permeable geotextile material comprises continuous warp filaments running in a machine direction and continuous weft filaments running in a transverse direction.

23. The sediment-control fence of claim 1, wherein the permeable geotextile material has an apparent opening size of less than 0.6 mm minimum average roll value MARV as measured according to American Society for Testing and Materials ASTM D4751.

24. The sediment-control fence of claim 1, wherein the sediment-control fence has an ultimate wide width tensile strength in the machine direction of greater than 1,000 lbs/ft MARV as measured according to ASTM D4595 across the installed height.

25. The sediment-control fence of claim 24, wherein the permeable geotextile material comprises a woven fabric comprising a plain weave, and the sediment-control fence has an overall modulus of greater than 1,500 lbs/ft MARV as measured according to ASTM D4595 across the installed height.

26. The sediment-control fence of claim 25, wherein the permeable geotextile material has a clean-water flux MARV of from 10 to 225 gpm/ft$^2$ as measured according to ASTM D4491.

27. The sediment-control fence of claim 1, wherein the sediment-control fence has an ultimate grab tensile strength in the machine direction measured at the primary center of pressure strap of from 700 to 7,400 lbs MARV as measured according to ASTM D4632.

28. The sediment-control fence of claim 1, wherein the sediment-control fence has an ultimate grab tensile strength in a machine direction measured at the primary center of pressure strap of at least 400 lbs MARV as measured according to ASTM D4632.

29. The sediment-control fence of claim 1, wherein the sediment-control fence has an ultimate grab tensile strength in a machine direction measured at the primary center of pressure strap of at least 676 lbs MARV as measured according to ASTM D4632.

30. A sediment-control fence system comprising:

anchoring posts;

a permeable geotextile material comprising a woven fabric having a lower grade line and an upper edge defining an installed height extending between the lower grade line and the upper edge, and having a substantially consistent apparent opening size along the installed height;

an overtopping strap adjacent to the upper edge of the permeable geotextile material; and a primary center of pressure strap having a width running along a length of the permeable geotextile material at a height between the lower grade line and the upper edge corresponding to a height of the center of pressure at overtopping, wherein the height of the center of pressure at overtopping falls within the width of the primary center of pressure strap; and wherein the sediment-control fence is attachable to the anchoring posts with a plurality of fasteners.

31. The sediment-control fence system of claim 30, wherein at least one of the overtopping strap and the primary center of pressure strap comprise a post-tensioning tendon that is attachable to the anchoring posts.

32. The sediment-control fence of claim 30, wherein the sediment-control fence has an ultimate grab tensile strength in the machine direction measured at the primary center of pressure strap of from 700 to 7,400 lbs MARV as measured according to ASTM D4632.

33. The sediment-control fence of claim 30, wherein the sediment-control fence has an ultimate grab tensile strength in the machine direction measured at the primary center of pressure strap of at least 400 lbs MARV as measured according to ASTM D4632.

34. The sediment-control fence of claim 30, wherein the sediment-control fence has an ultimate grab tensile strength in a machine direction measured at the primary center of pressure strap of at least 676 lbs MARV as measured according to ASTM D4632.

* * * * *